US012503932B2

(12) United States Patent
Snitkoff et al.

(10) Patent No.: US 12,503,932 B2
(45) Date of Patent: Dec. 23, 2025

(54) SAND SCREEN, METHOD, AND SYSTEM

(71) Applicant: Baker Hughes Oilfield Operations LLC, Houston, TX (US)

(72) Inventors: Joshua Snitkoff, Friendswood, TX (US); Santosh Reddy Sama, Spring, TX (US); Jeffrey A. Higginbotham, Humble, TX (US); Levi B. Oberg, Cypress, TX (US); Ronnie D. Russell, Cypress, TX (US); Charles A. McClean, Spring, TX (US); Michael P. Stricker, Magnolia, TX (US); Amrit Balgobin, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/657,313

(22) Filed: May 7, 2024

(65) Prior Publication Data

US 2024/0376806 A1 Nov. 14, 2024

Related U.S. Application Data

(60) Provisional application No. 63/501,038, filed on May 9, 2023.

(51) Int. Cl.
*E21B 43/10* (2006.01)
*E21B 43/08* (2006.01)

(52) U.S. Cl.
CPC ..... *E21B 43/10* (2013.01); *E21B 43/082* (2013.01)

(58) Field of Classification Search
CPC ..... E21B 43/08; E21B 43/082; E21B 43/084; E21B 43/086; E21B 43/088
See application file for complete search history.

(56) References Cited

U.S. PATENT DOCUMENTS 2,391,609 A 12/1945 Wright
5,339,895 A * 8/1994 Arterbury ..... B01D 29/15 166/227

(Continued)

FOREIGN PATENT DOCUMENTS

JP 2008082682 A 4/2008
WO 2018052448 A1 3/2018
WO 2019164607 A1 8/2019

OTHER PUBLICATIONS

ASTM E11 Standard https://cdn.standards.iteh.ai/samples/112382/292f6d70fa1749b180ce6e69a138010d/ASTM-E11-22.pdf 2022 (Year: 2022).*

(Continued)

*Primary Examiner* — David Carroll
(74) *Attorney, Agent, or Firm* — CANTOR COLBURN LLP

(57) ABSTRACT

A screen including a filtration media having a manufactured structure with an interface portion and a filtration portion, the filtration portion having a homogenous geometry that precisely balances flow through all flow paths through the media. A method for making a screen including determining a geometric shape of each flow path through a prospective filtration media, sequentially progressively building the media particle by particle ensuring the geometric shape of each flow path is within 0.01 mm of a design geometry, and fusing each build particle to the foregoing build particle. A borehole system, including a borehole in a subsurface formation, a string in the borehole, and a screen and or plurality of individually designed screens disposed or geometrically distributed within or as a part of the string.

18 Claims, 41 Drawing Sheets

(56) References Cited

U.S. PATENT DOCUMENTS

| | | | | |
|---|---|---|---|---|
| 2004/0011726 | A1 | 1/2004 | Weh et al. | |
| 2012/0034377 | A1* | 2/2012 | Hailey, Jr. | E21B 43/04 427/244 |
| 2022/0290532 | A1* | 9/2022 | Brohi | E21B 43/084 |
| 2024/0328310 | A1* | 10/2024 | Steele | E21B 47/16 |

OTHER PUBLICATIONS

How to Design High-Performance filters for additive manufacturing, May 6, 2021 [retrieved on Aug. 9, 2024]. Retrieved <URL: https://www.ntop.com/resources/blog/designing-high-performance-filters-foradditive-manufacturing>. pges 1-8, figs 1-9.

Notification of Transmittal of the International Search Report and the Written Opinion of the International Searching Authority, or the Declaration; PCT/US2024/028260; mail date Aug. 27, 2024; 9 pages.

* cited by examiner

SAND SCREEN, METHOD, AND SYSTEM

CROSS REFERENCE TO RELATED APPLICATIONS

This application claims the benefit of an earlier filing date from U.S. Provisional Application Ser. No. 63/501,038 filed May 9, 2023, the entire disclosure of which is incorporated herein by reference.

BACKGROUND

In the resource recovery and fluid sequestration industries controlling fines entrained in fluids to be displaced is always a concern. Many different types of screens have been created over the long years since hydrocarbon recovery began with each having utility and competency for different applications. A problem that is ubiquitous is that hot spots occur in screens and cause them to burn out ahead of anticipated service life. The art would welcome alternatives that controls this problem thereby improving service life of screens.

SUMMARY

An embodiment of a screen including a filtration media having a manufactured structure with an interface portion and a filtration portion, the filtration portion having a homogenous geometry that precisely balances flow through all flow paths through the media.

An embodiment of a method for making a screen including determining a geometric shape of each flow path through a prospective filtration media, sequentially progressively building the media particle by particle ensuring the geometric shape of each flow path is within 0.01 mm of a design geometry, and fusing each build particle to the foregoing build particle.

An embodiment of a borehole system, including a borehole in a subsurface formation, a string in the borehole, and a screen and or plurality of individually designed screens disposed or geometrically distributed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
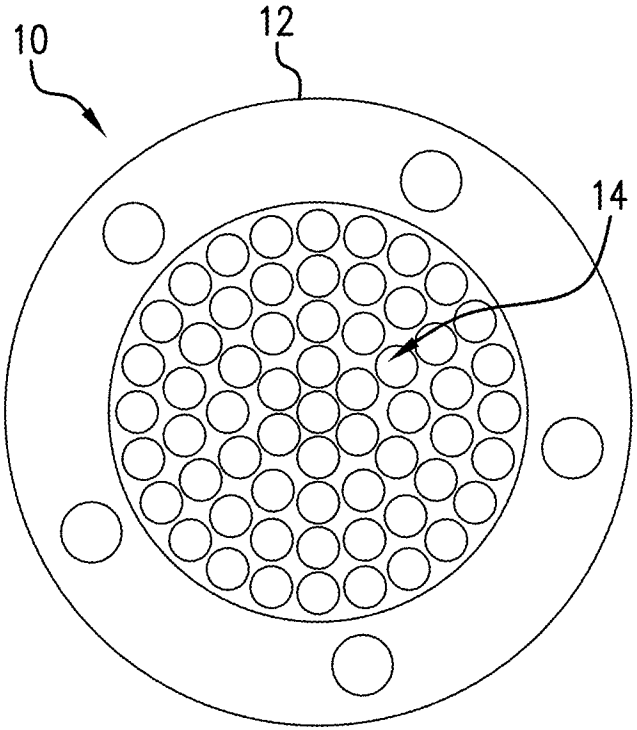
FIG. 1 (PRIOR ART)
FIG. 1 is a prior art screen.
Figure 3:
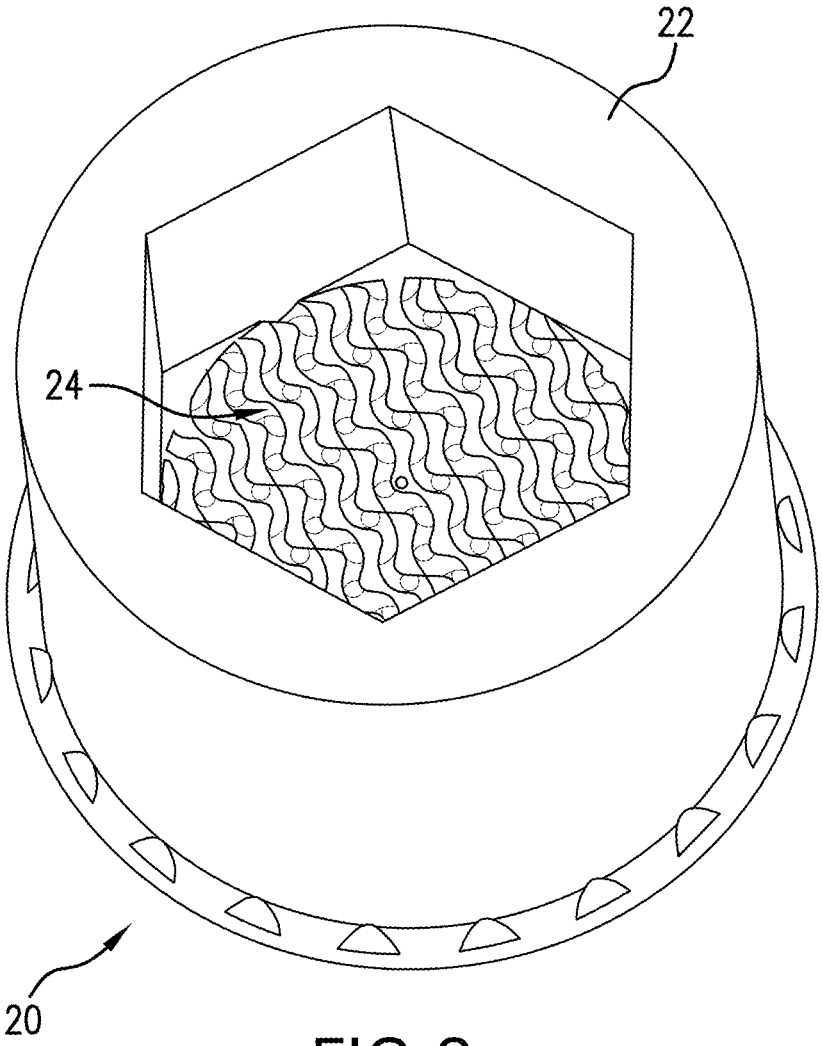
FIGS. 3-5 are views of the embodiments of FIG. 2 providing greater understanding of the pattern illustrated.
Figure 4:
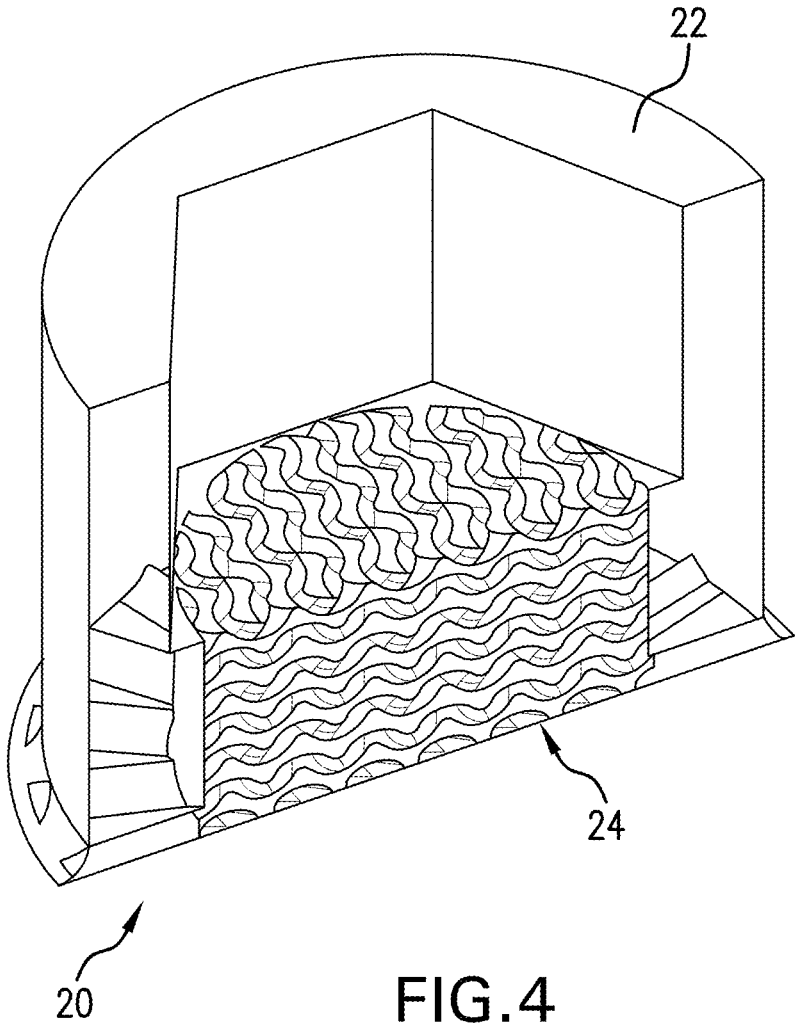
Figure 5:
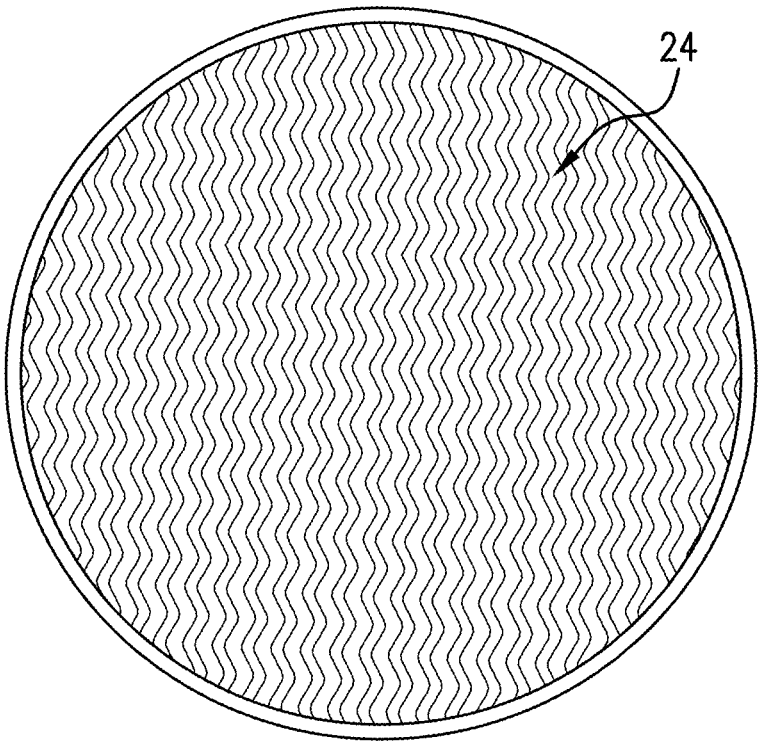
Figure 6:
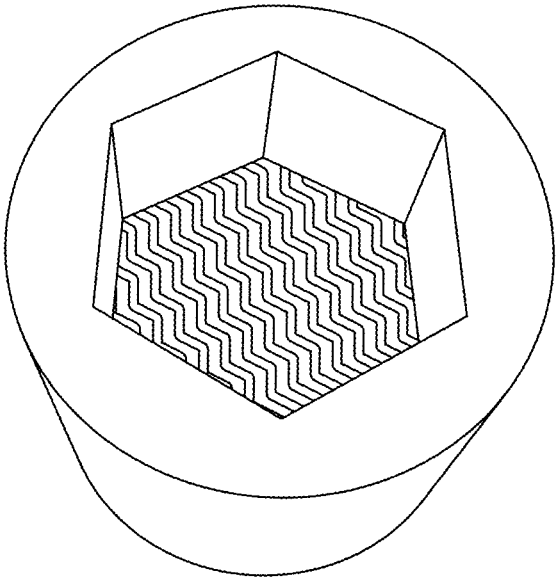
FIGS. 6-7 are additional views of the embodiment of FIG. 2.
Figure 7:
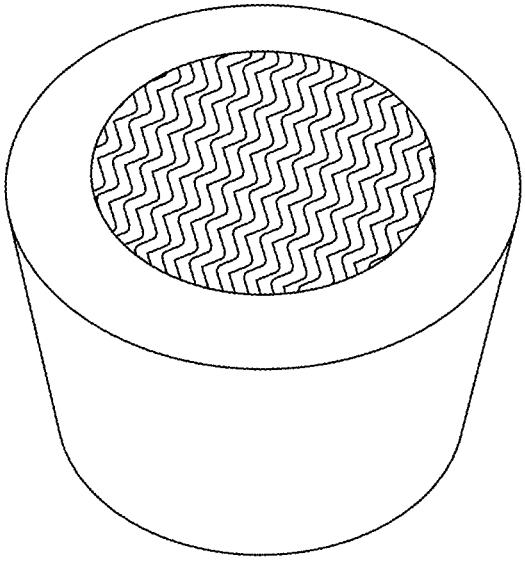

Referring to FIG. 1, a prior art screen 10 is illustrated. The screen 10 comprises a housing 12 that is filled with a bead pack 14 that is sintered together. Screen 10 has been well used in the art and works well for its purpose but the inventors hereof have discovered that an unexpected improvement in longevity of screens and an unexpected improvement in the flow distribution of screens can be achieved. Screen 10 was widely believed to be a significant improvement over older technology screens in terms of flow performance and resistance to hot spot failure, which has always been an accepted part of the life cycle of a screen.

Figure 2:
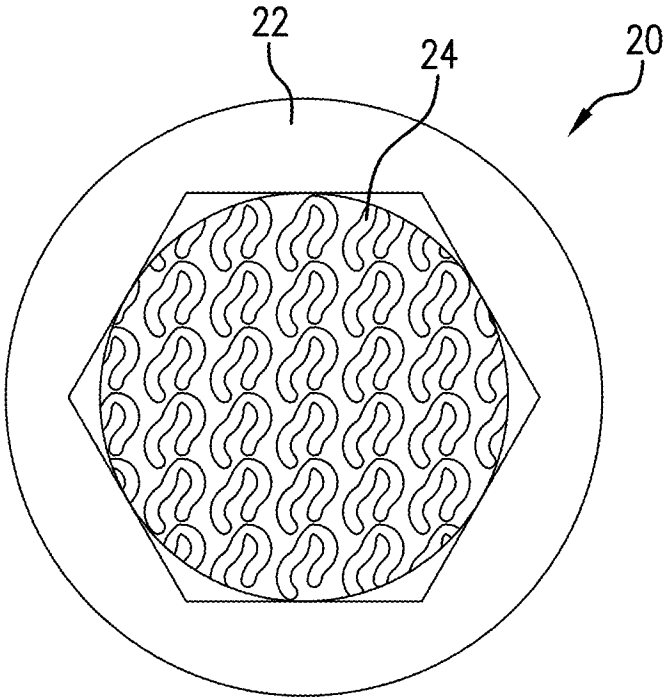
FIG. 2 is a view of a first embodiment of the screen disclosed herein.

Referring to FIG. 2, a screen 20 is disclosed herein. Screen 20 comprises a structure interface portion 22 and a filtration portion 24. Interface portion 22 may be arranged a press fit, threaded fit, weld fit, etc. and may provide for a drive geometry in the form of hexagonal or square faces, for example. The interface portion 22 may be a feature of the filtration portion 24 or may be configured as a housing that is created in the same formation build as the filtration portion or may be created independently with the filtration portion 24 being disposed therein afterward. While the screen 20 may be created with traditional subtractive machining operations or built from individual components, the screen 20 is most easily created using an additive manufacturing process. Through the additive manufacturing process, the inventors discovered that with a geometry of a flow path through the filtration portion 24 closely controlled to be much more homogenous than in the prior art screen 10, a significantly greater resistance to hot spots and improved flow over the life of the screen 20 is obtained. Flow is precisely balanced through the media 26 thereby eliminating or significantly reducing the potential for hot spots. By "precisely" it is meant that flow is evenly distributed over the surface area and or volume of the media 26 to within +/−0.01 mm. In addition to the precisely controlled filtration properties the media 26 when embodied as a single volume of material is manufactured with a self-supporting structure that improves structural integrity of the media 26 such as by increasing collapse load while maximizing its cross sectional flow area.

Referring to FIGS. 2-7, a pattern of a filtration media 26 is illustrated. The media 26 may make up all or a portion of the filtration portion 24. As illustrated in FIG. 2-7, the media 26 is the entirety of the filtration portion 24. The structure is a lattice of sinuous appearance having repeating units of material duplicated in both an X plane and a Y plane, to forma a tortuous flow path through the media 26 that has consistent flow path dimensions at all places within the media. This ensures a homogenous distribution of flow area throughout the volume of the material, and therefore a reduction in hot spotting and erosion.

Figure 8:
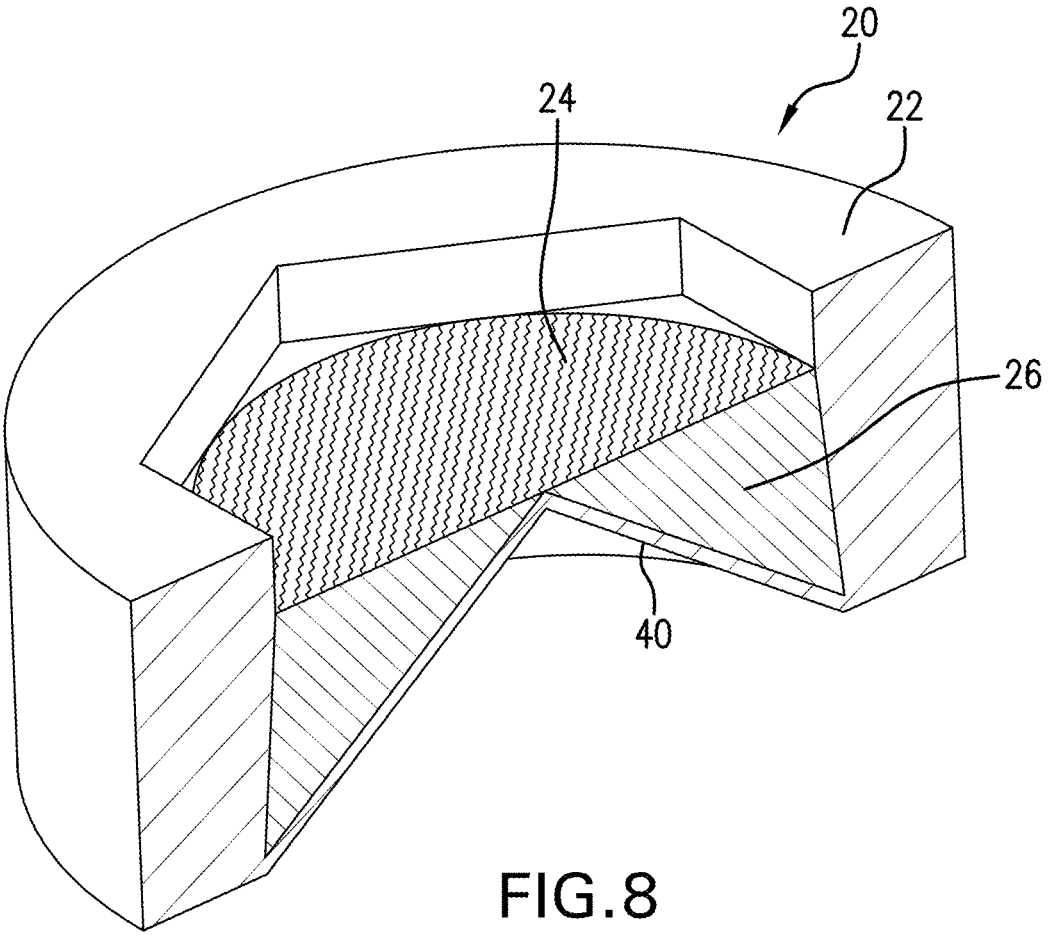
FIG. 8 is a perspective view of another embodiment or sub embodiment as the macro structure thereof may be applied to the other embodiments having different patterns of media.

Referring to FIG. 8, another embodiment of screen 20 is illustrated that employs a conical depression 40 in the media 26 extending with its point in an upstream direction of flow, during use. The embodiment is one example of a self supporting structure that may be employed with any media pattern with similar results.

Figure 9:
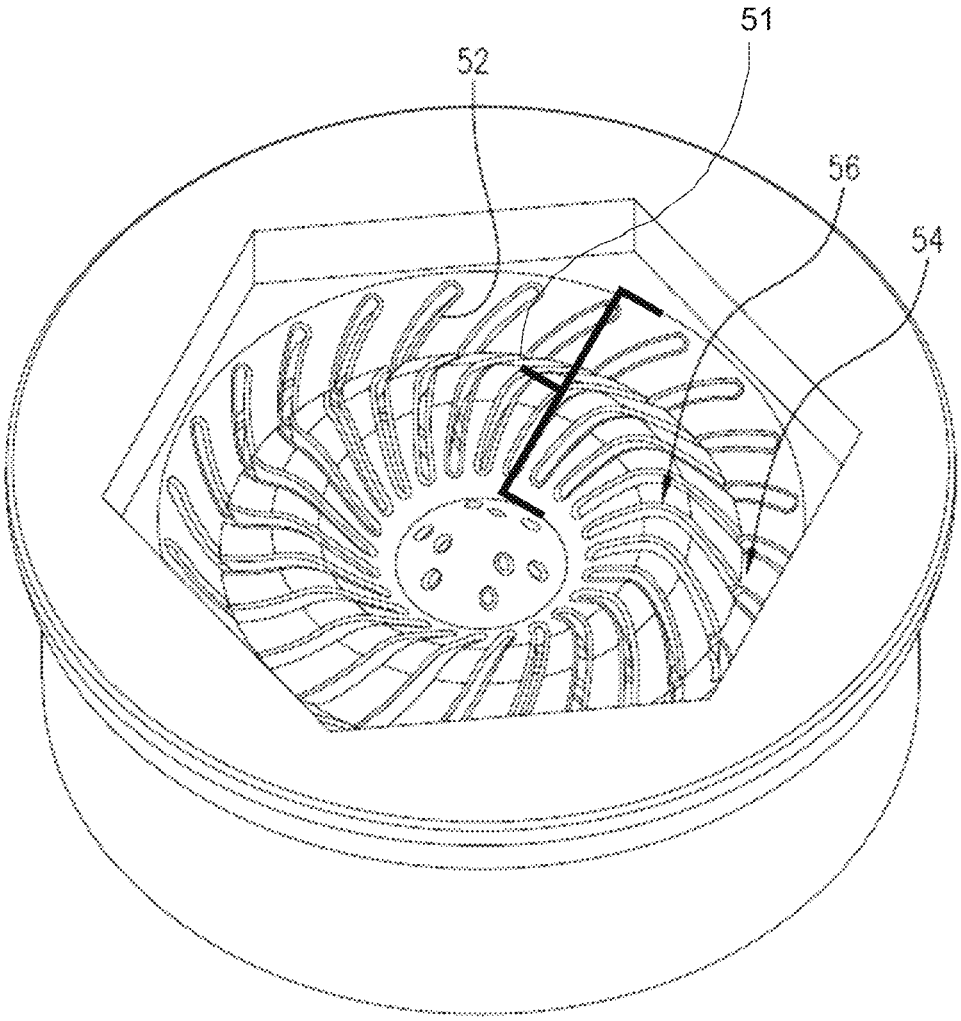
FIG. 9 is another embodiment of screen disclosed herein.
Figure 10:
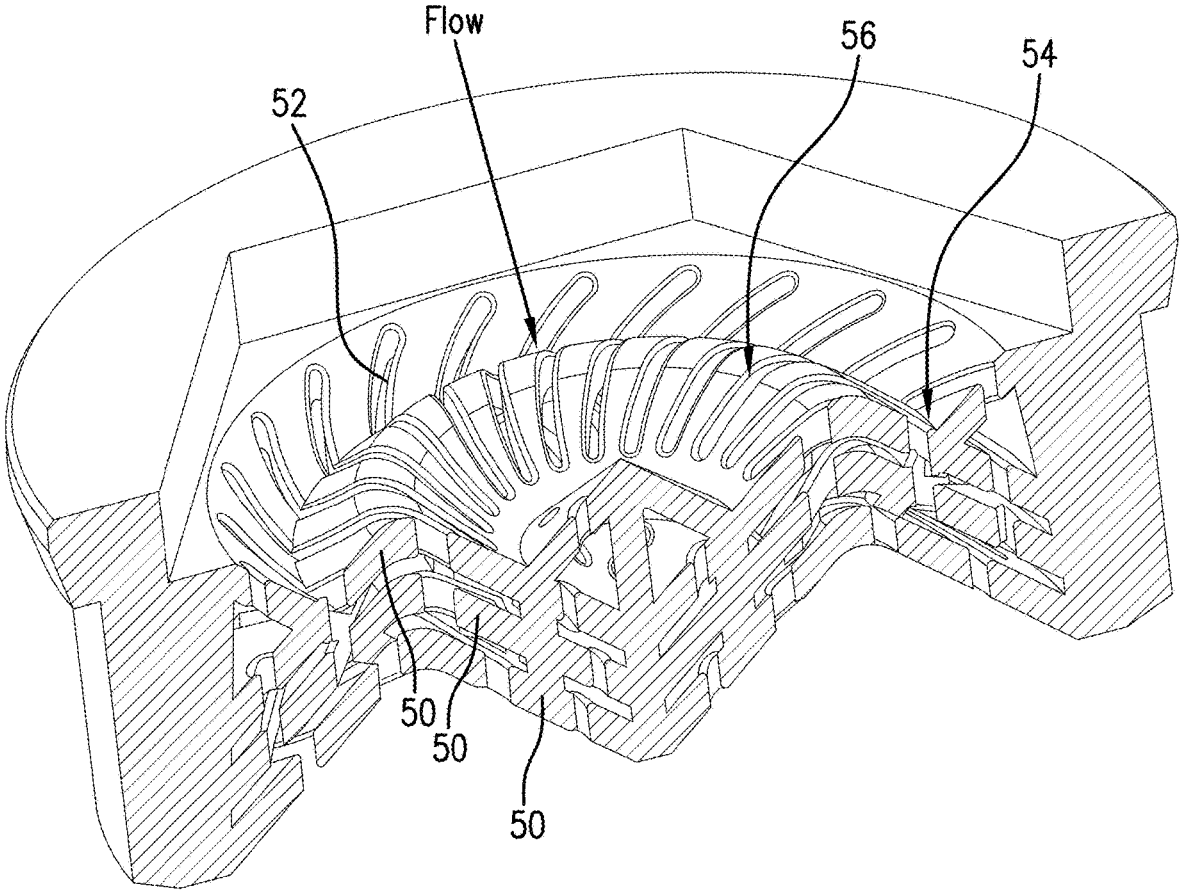
FIG. 10 is a cross section view of FIG. 9.

Referring to FIG. 9, another embodiment of screen 20 is illustrated. The embodiment includes layers 50 that make up media 26. One or more of the layers 50 include arcuate openings 52. Referring to FIG. 10, it can be seen that three layers 50 are present. More or fewer are of course contemplated and it should be understood that layers may be individually manufactured or may be formed in one process using an additive manufacturing process. It is further to be understood that the arcuate openings 52 may have a curve direction that alternates direction at each level (this can be seen in FIG. 11) or may all be curved in the same direction. In embodiments with curves in alternating directions, it should be understood that there will be a straight through passage where curve of adjacent layers 50 intersect one another (in different planes). Put another way, if one were to shine a light through the media 26, there would be revealed some pathways that lead straight through the media 26. In some embodiments where the openings curve in the same direction layer to layer, it may be desirable to rotationally offset the layers. This will increase tortuosity of the flow path through the media 26, eliminate straight through pathways, and therefore also provide some pressure drop for embodiments where these properties would be desirable.

Further with the embodiment of FIG. 9, the layers 50 are not flat but rather include arch-like, dome-like or vault-like structure. In some cases, the arch-like structure may be in the form of pleats (see pleated configuration 51 referenced in FIG. 9). In either event, the structure increases the flow area by increasing total area of the media 26. The arch-like structure also tends to collect particulates in valleys 54 thereby leaving the hills 56 open to flow for a longer period of time prior to plugging off.

Figure 11:
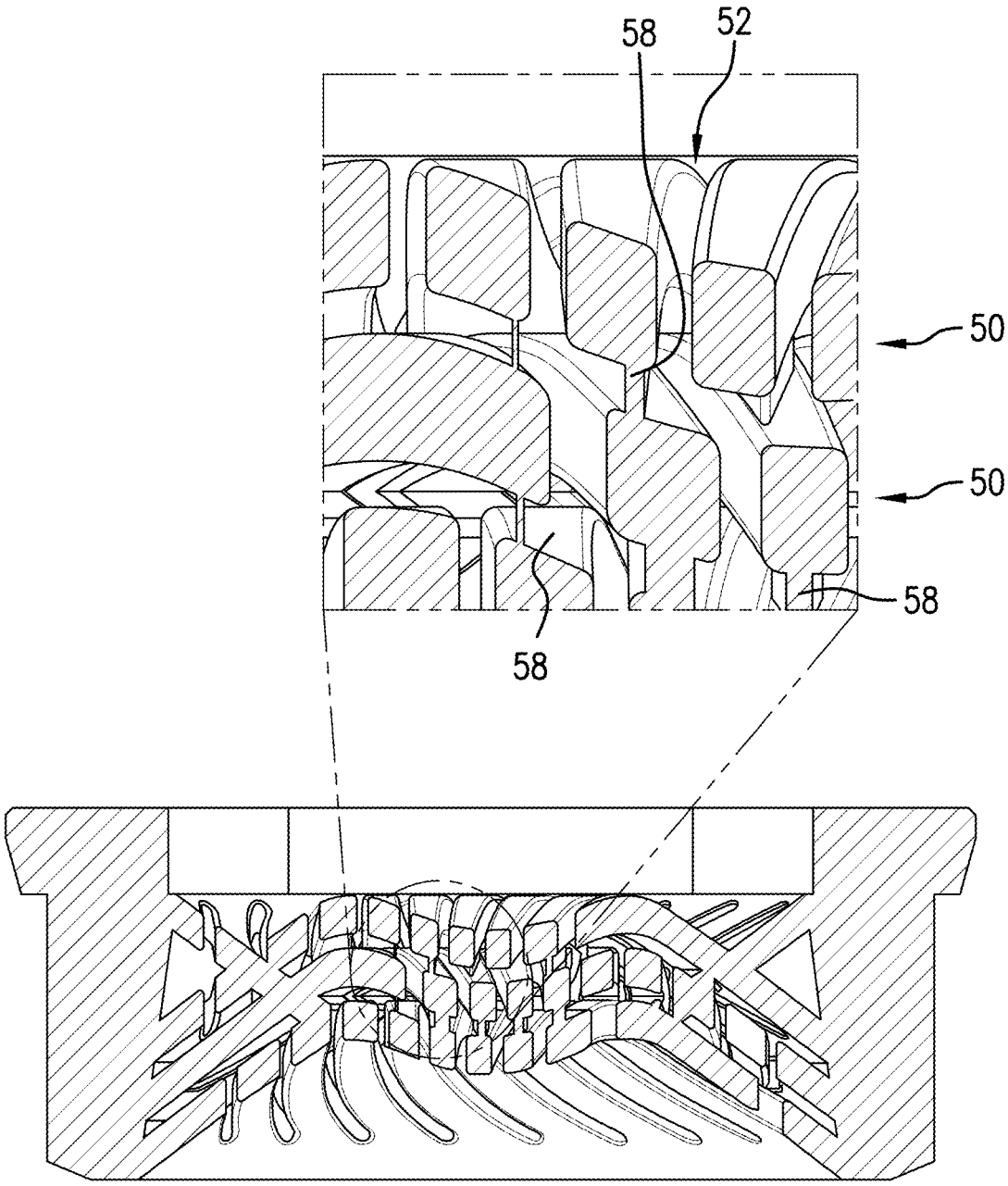
FIG. 11 is another cross section of FIG. 9 but taken not at the center like that of FIG. 10 but rather toward the back of the FIG. 9 view so that the cross section catches the openings toward the rear of the Figure.

Referring to FIG. 11, another feature of the embodiment of FIG. 10 is illustrated. The layers 50 are supported by internal supports 58, making the media 26 quite structurally robust.

In an iteration of the FIG. 9 embodiment, the openings 52 have sides 60 that are angled relative to a longitudinal axis 60 of the screen 20. This will cause fluid flowing therethrough to spin relative to the screen 20 which will tend to throw particulates to sides of the screen 20 thereby helping to keep the screen open to flow.

Another advancement provided by the disclosure hereof is the provision of a volumetric flow path through the media 26 that is determined and controllable during manufacture. The exact dimensions and length of a single or plurality of flow paths may be adhered to during manufacture hence providing precisely the distribution and pressure drop that is desired for the particular screen 20. In addition, the pathway(s) may also be configured as fluid diodes to provide inflow control as well as being a screen. A volumetric flow path that is not random in nature has not been known to the art, heretofore.

Another way to create a pressure drop for media 26 is to add one layer 50 at the downstream end of the media 26 having a significantly reduced flow area to that of the layers or one-piece media upstream thereof. By "significantly" it is meant more than 20 percent which is associated with a measurable pressure drop sufficient to keep flow balanced across all screens 20 used in a zone of a borehole. Such a layer 50 may be printed or may simply be a disk having smaller openings that is added after printing, for example.

While it has been noted above that the screen embodiments may be manufactured in traditional manners, additive manufacturing eliminates the assembly of such screens enabling a tight control of resulting media as well as making particular designs of flow paths through that media almost unlimited.

With an absolute control of the flow through the various embodiments of filtration media, systems having individual screens or groups of screens that have certain properties become possible. The disclosure hereof, due to the control of the flow enables systems that are optimized consistently with principle of conservation of mass. According to the principle, the mass flow rate of the fluid must remain constant along the flow path. Therefore, as the cross-sectional area decreases, the fluid must increase its velocity to maintain the same mass flow rate. By understanding and utilizing this principle, engineers can design efficient systems that take advantage of the accelerated flow and reduced pressure at the exit of a restricted orifice(s) to minimize the erosion and maximize the longevity of the sand control system. The system is parameterized in which the geometries and dimensions of the single structure are directly influenced by the input variables, in this case the sand control requirements such as solid particle size distribution, flow type, fluid velocity, viscosity, etc. This detailed control allows for tailoring of flow properties of the system to a particular reservoir need easily.

Figure 12:
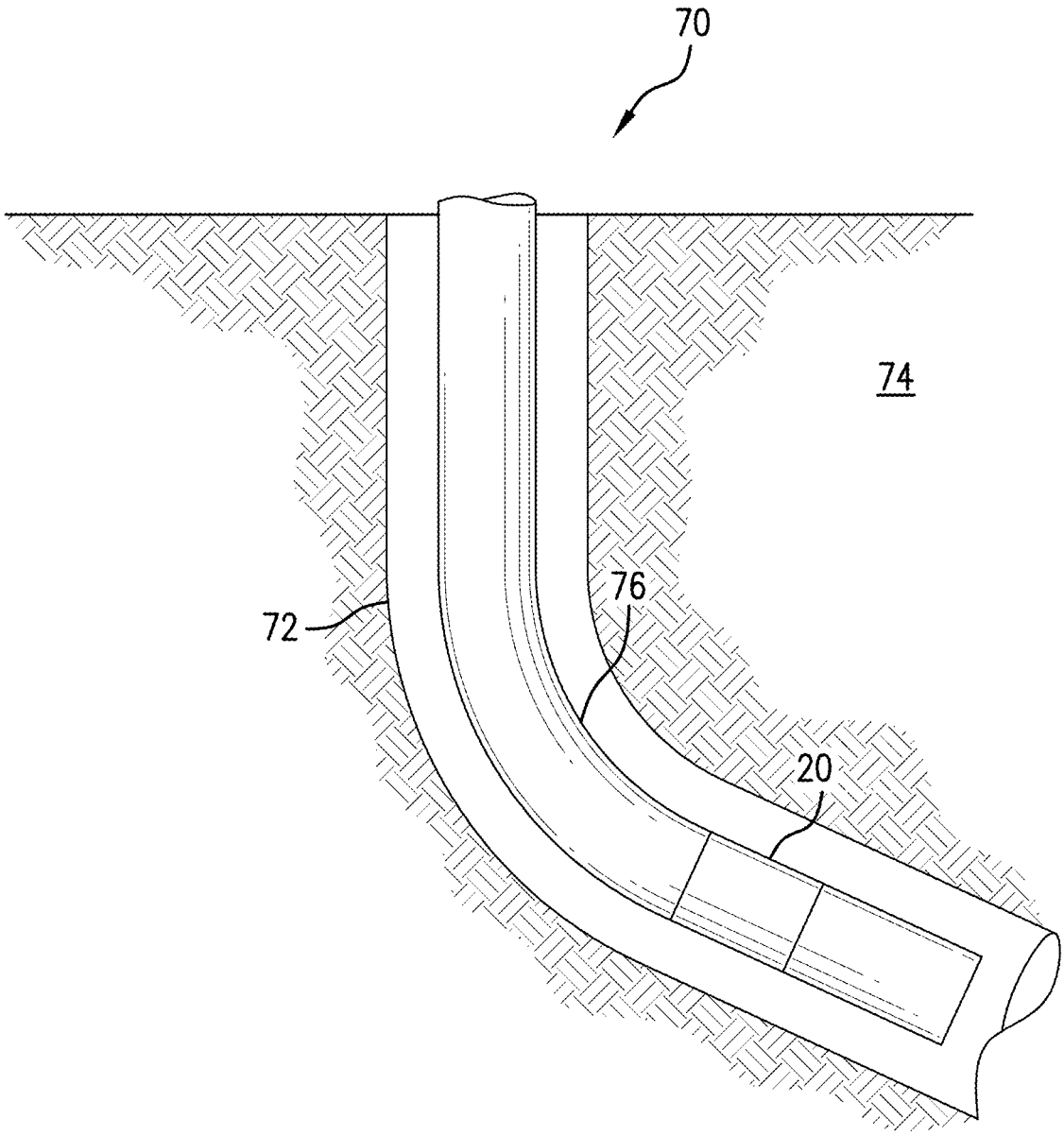
FIG. 12 is a view of a borehole system including a screen as disclosed herein.
Figure 13A:
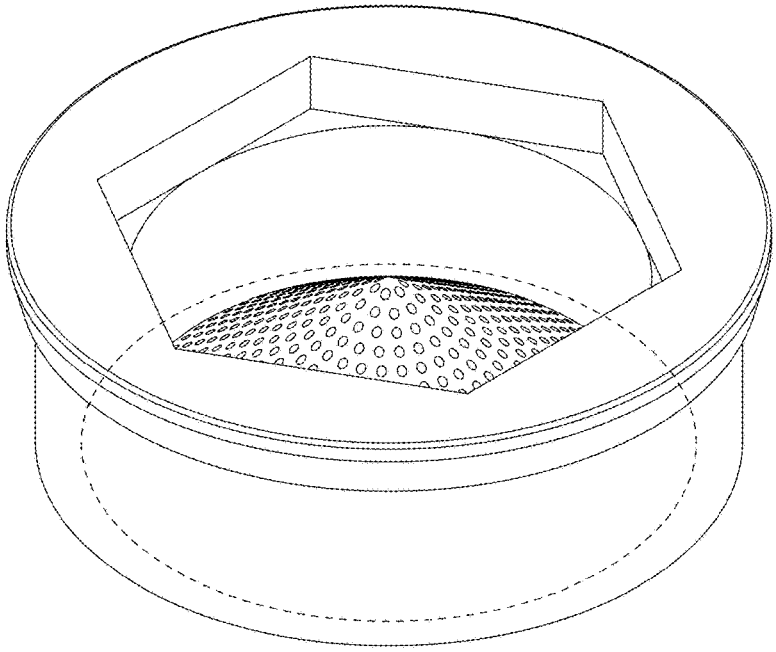
FIG. 13A-13J is an alternate embodiment.
Figure 13B:
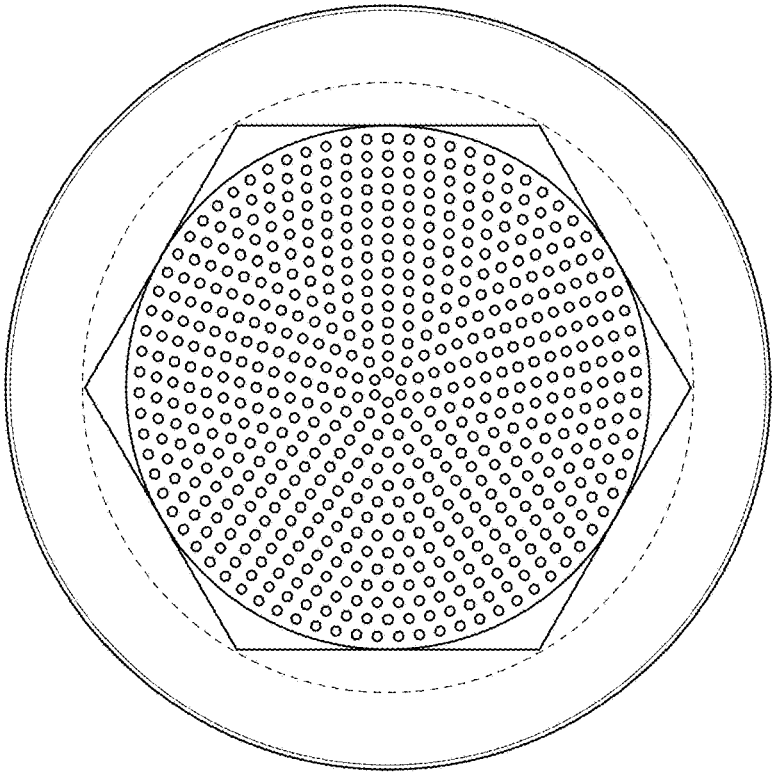
Figure 13C:
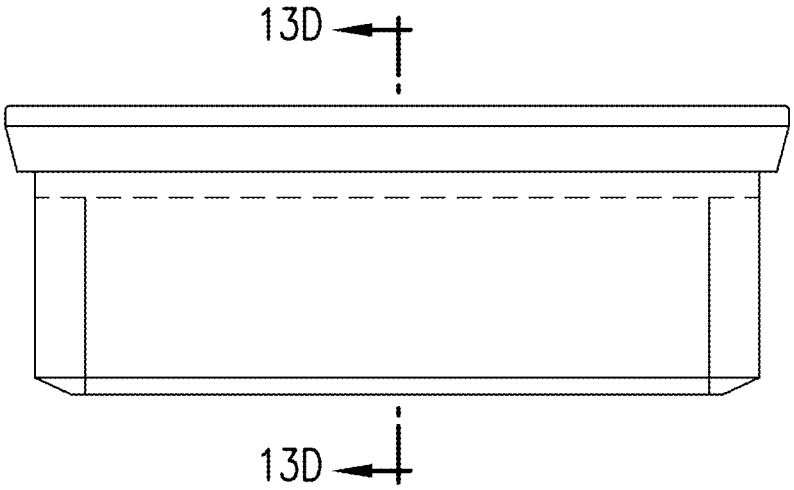
Figure 13D:
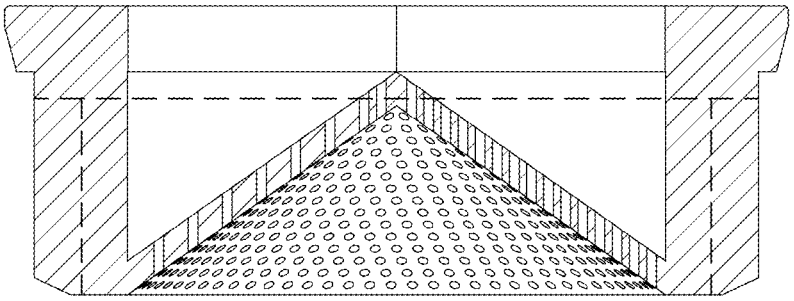
Figure 13E:
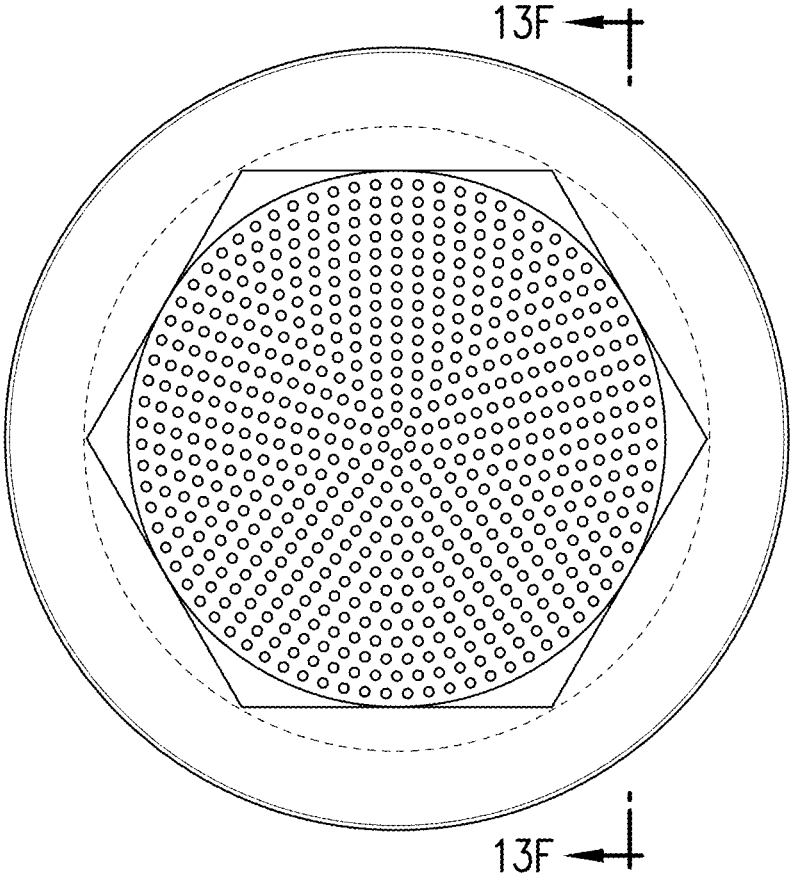
Figure 13F:
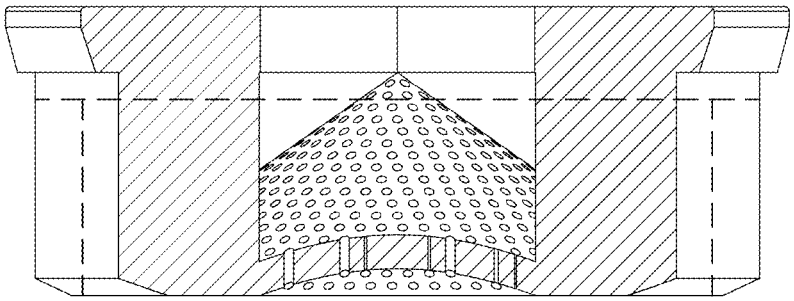
Figure 13G:
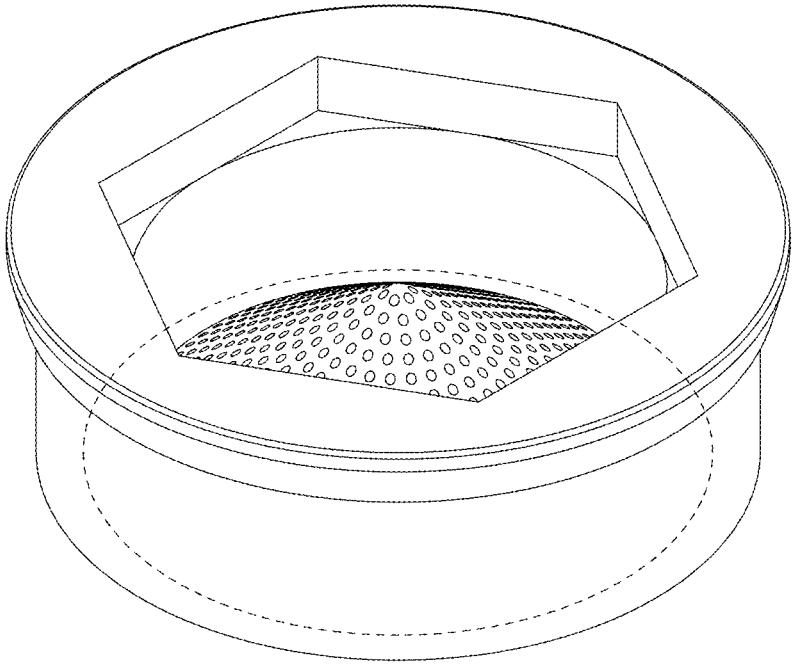
Figure 13H:
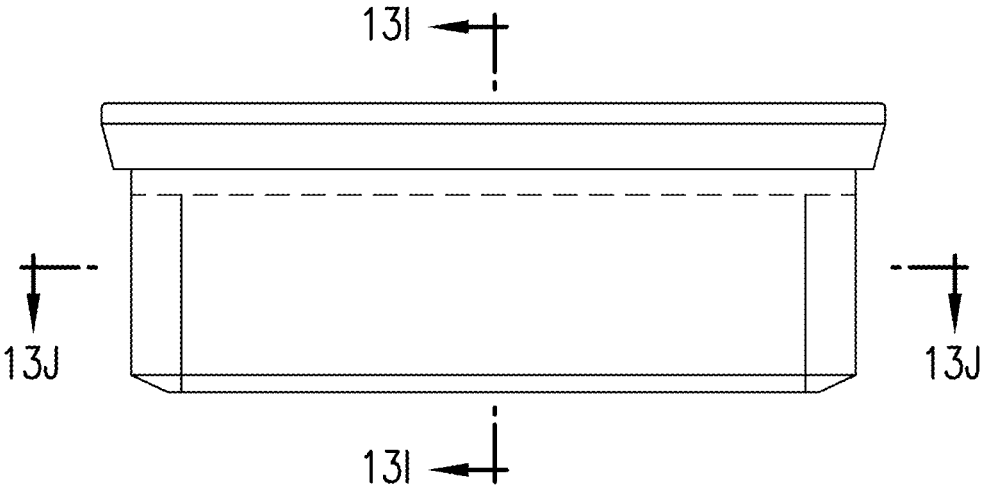
Figure 13I:
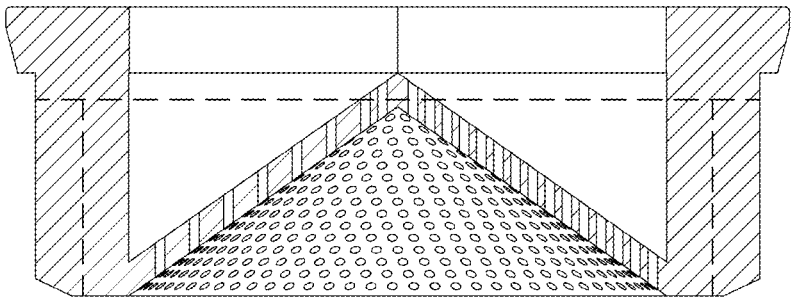
Figure 13J:
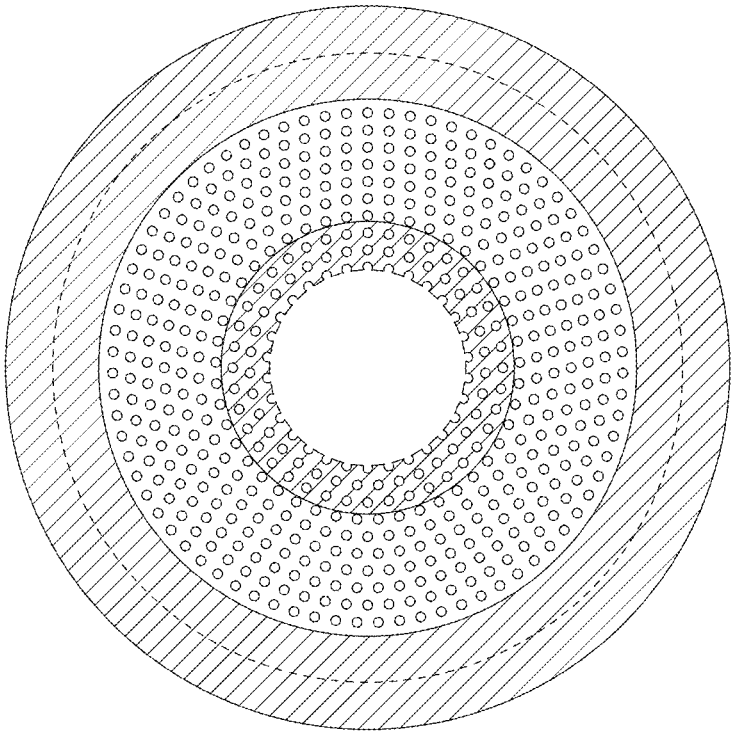
Figure 14A:
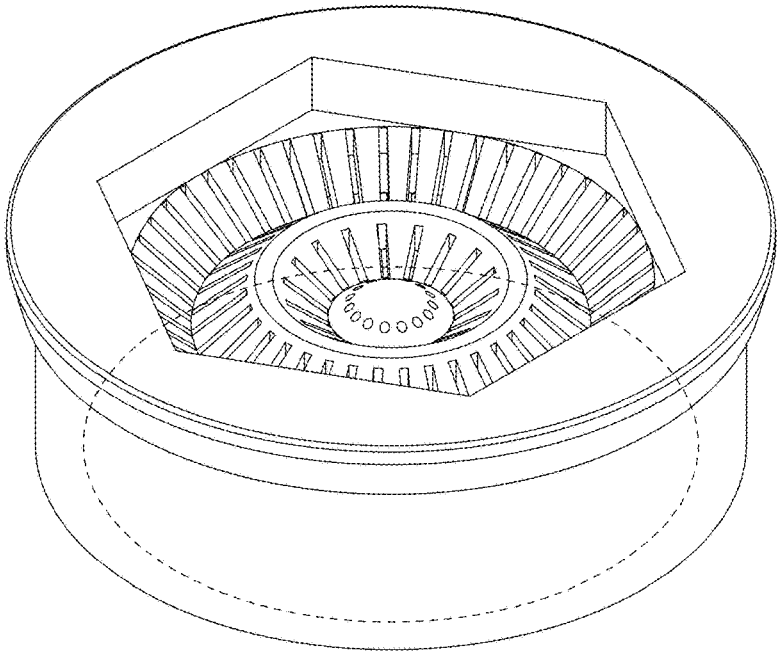
FIG. 14A-14O is an alternate embodiment.
Figure 14B:
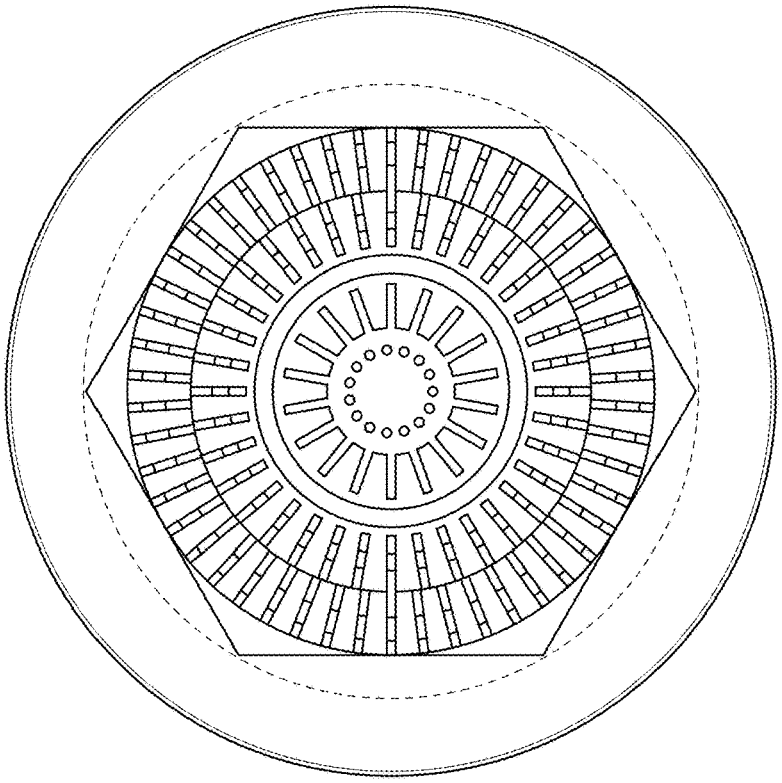
Figure 14C:
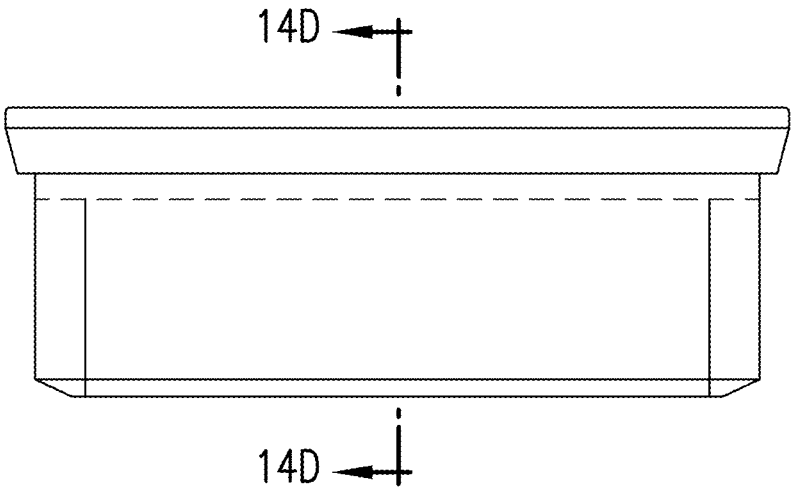
Figure 14D:
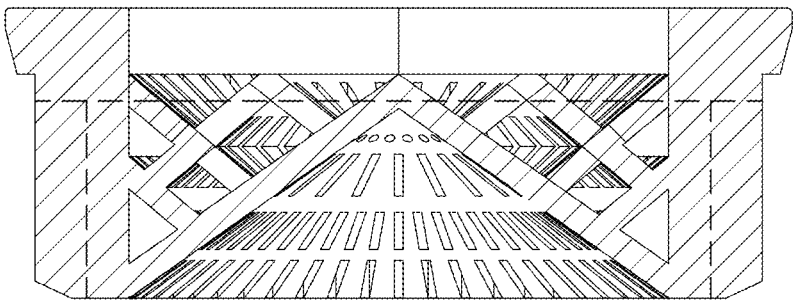
Figure 14E:
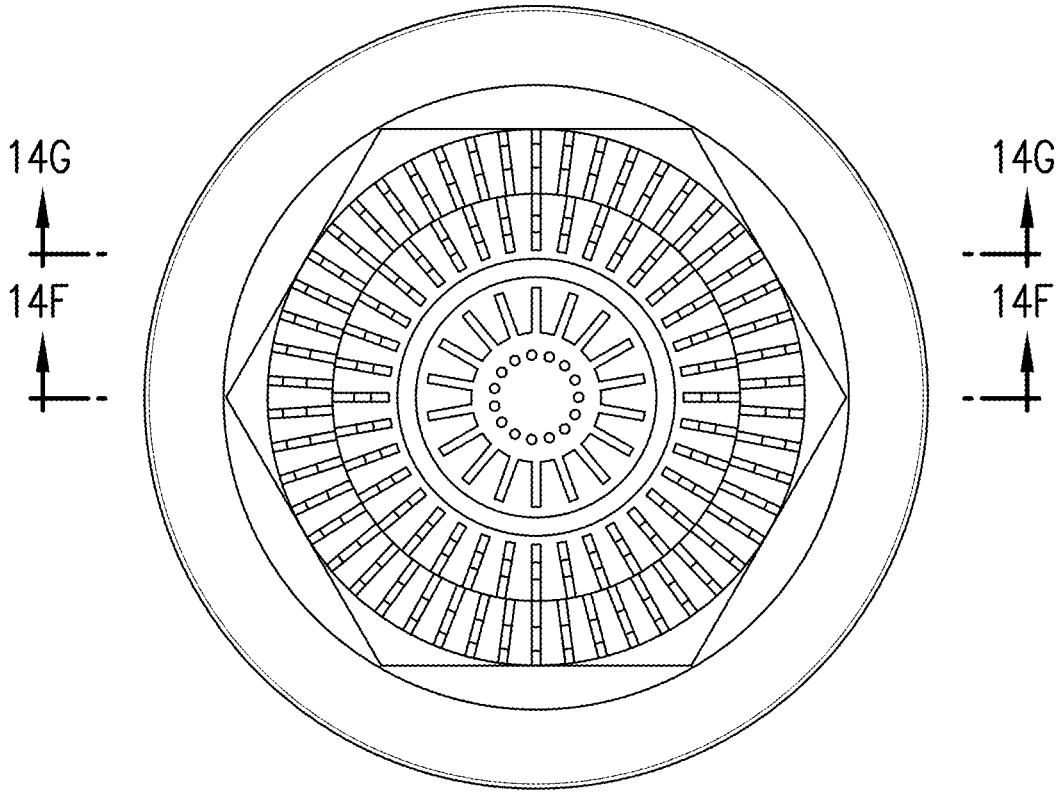
Figure 14F:
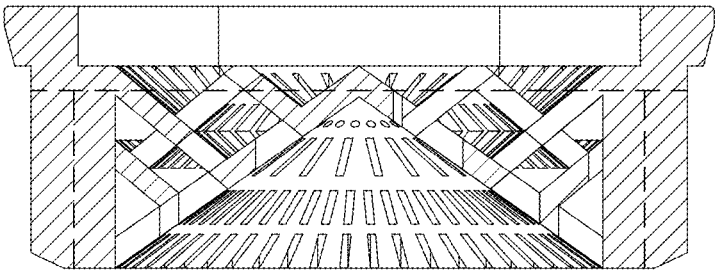
Figure 14G:
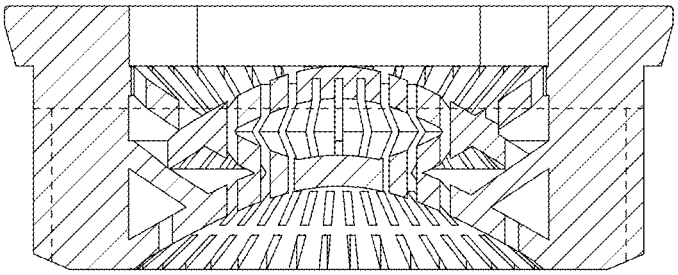
Figure 14H:
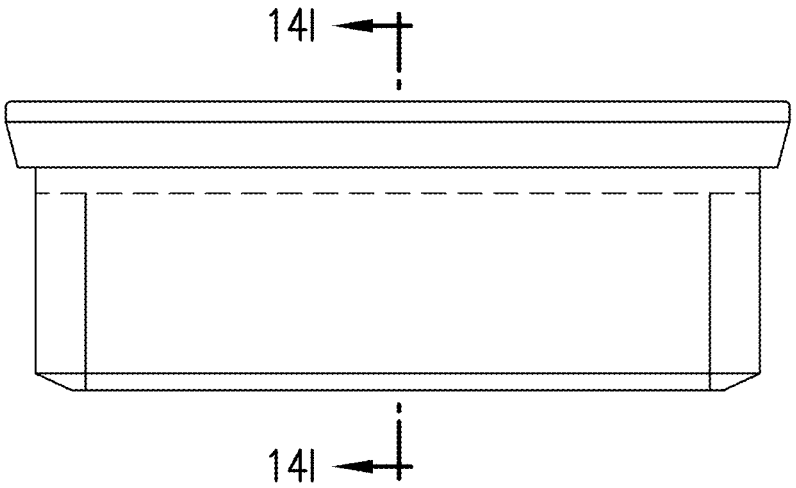
Figure 14I:
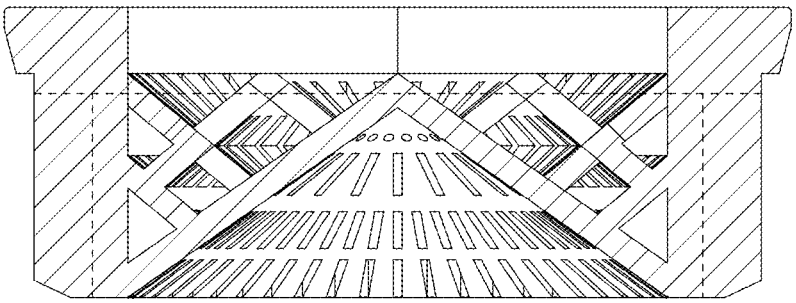
Figure 14J:
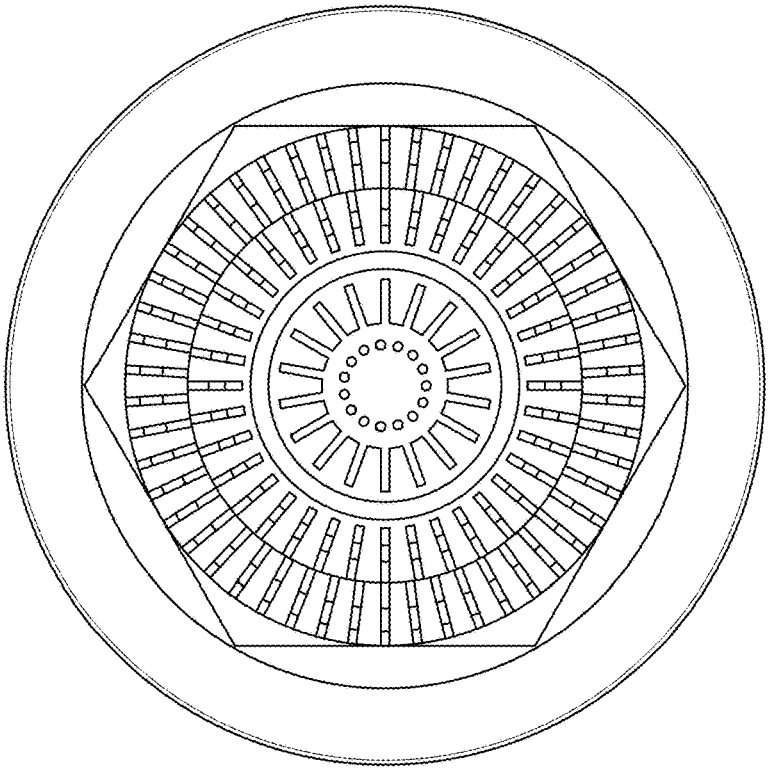
Figure 14K:
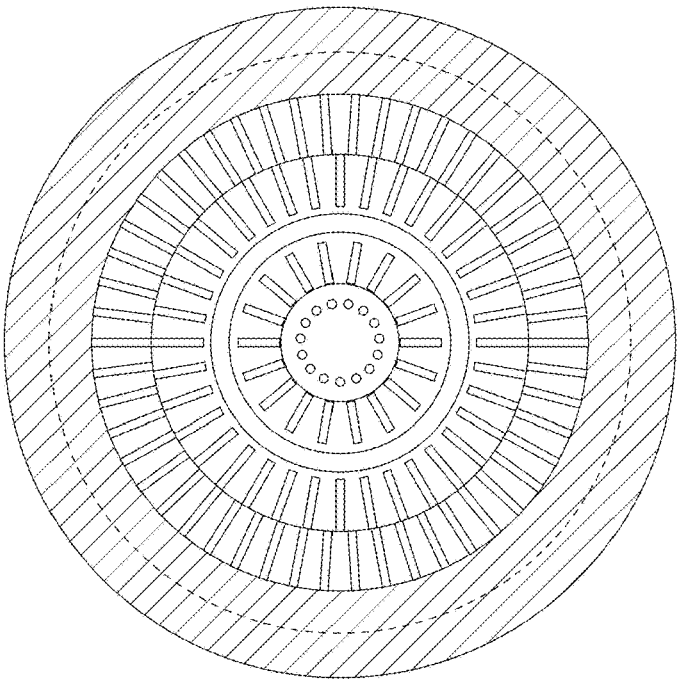
Figure 14L:
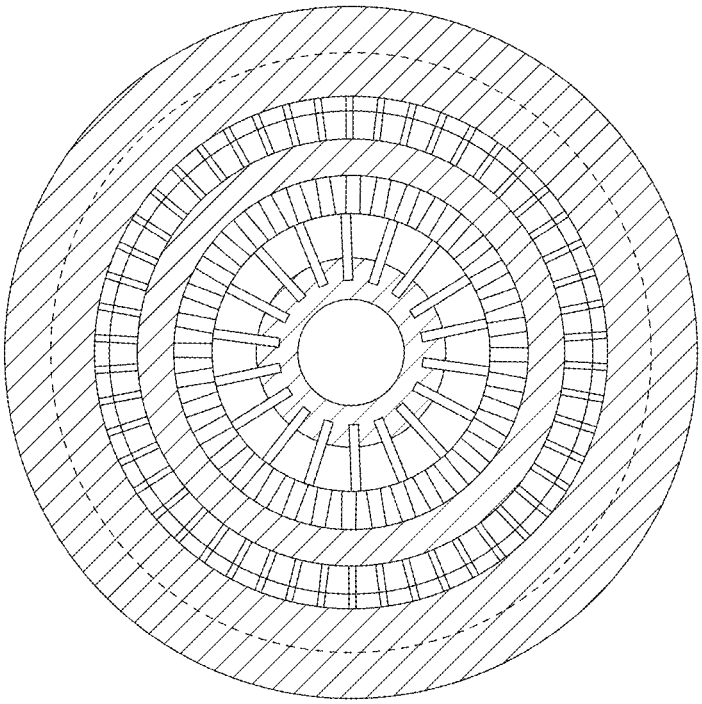
Figure 14M:
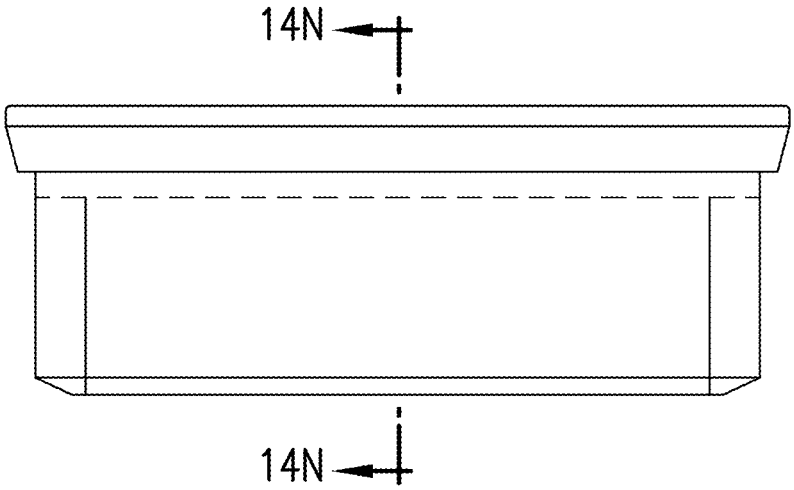
Figure 14N:
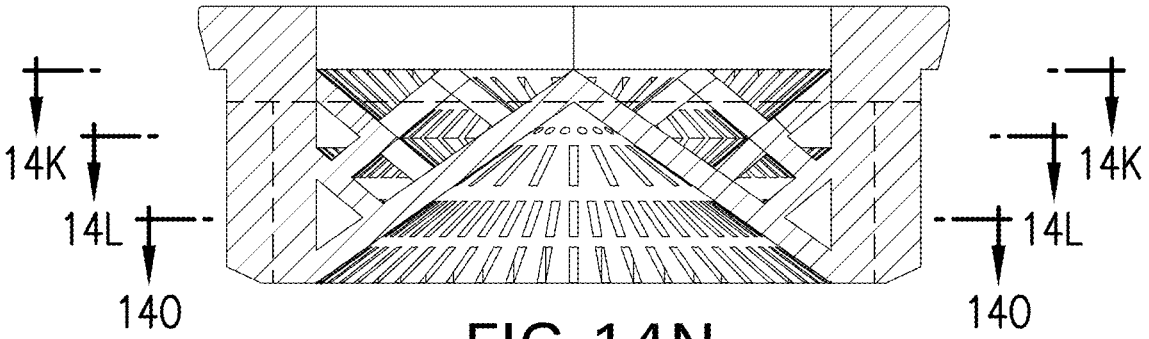
Figure 14O:
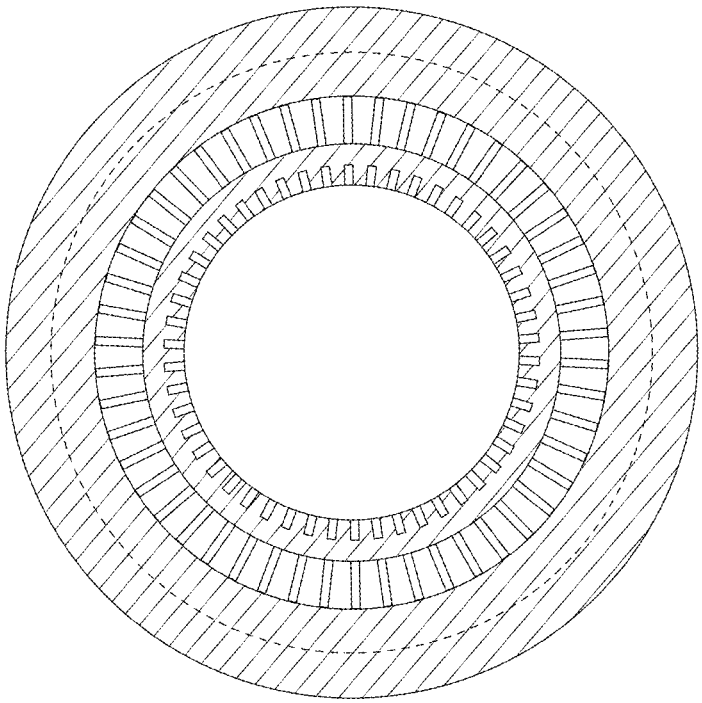
Figure 15A:
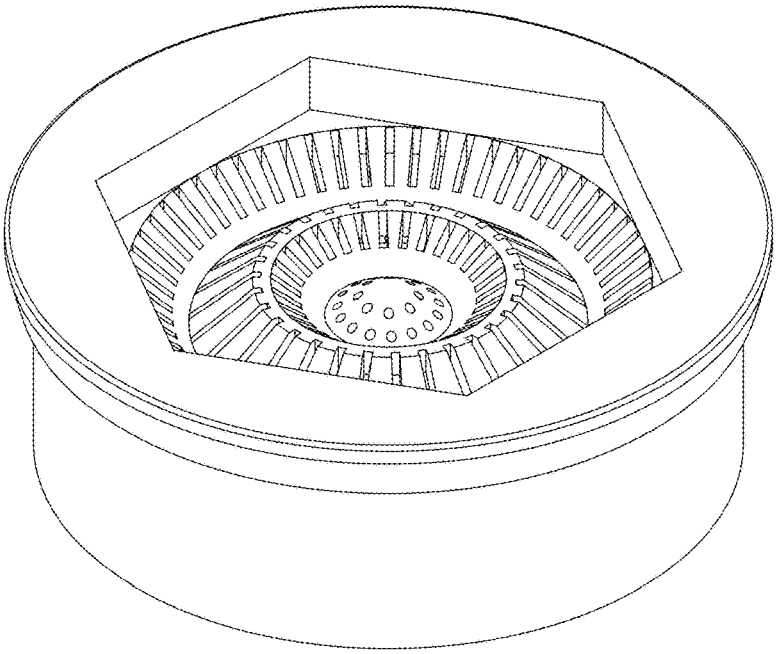
FIG. 15A-15O is an alternate embodiment.
Figure 15B:
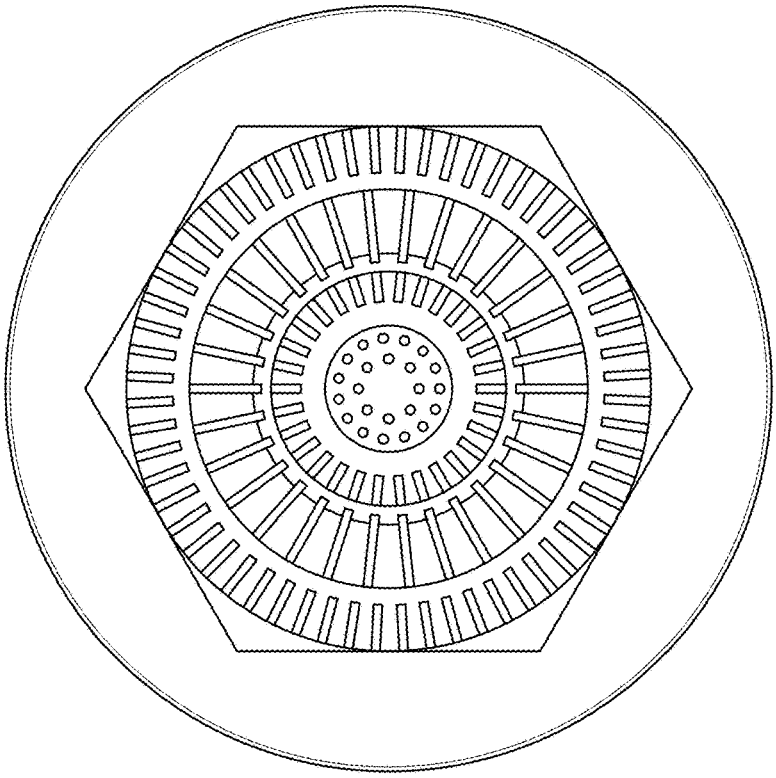
Figure 15C:
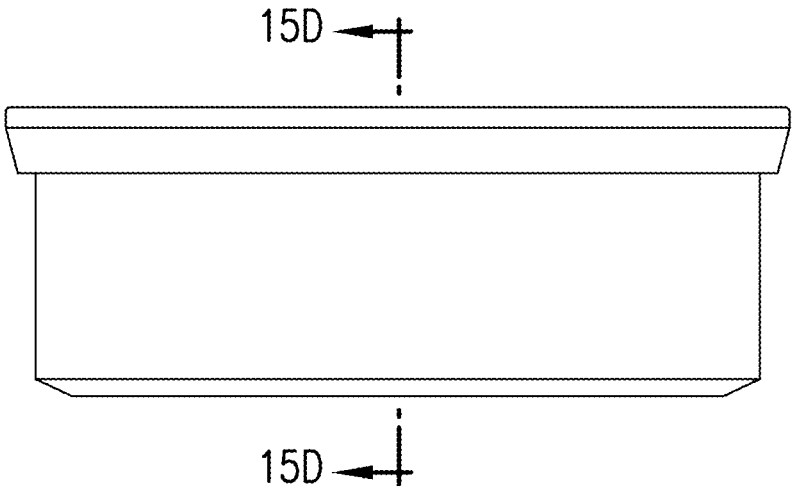
Figure 15D:
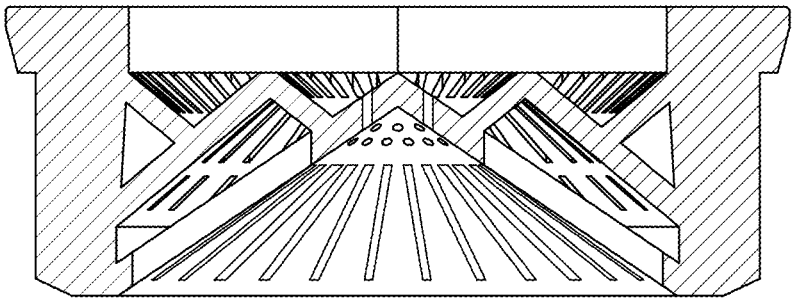
Figure 15E:
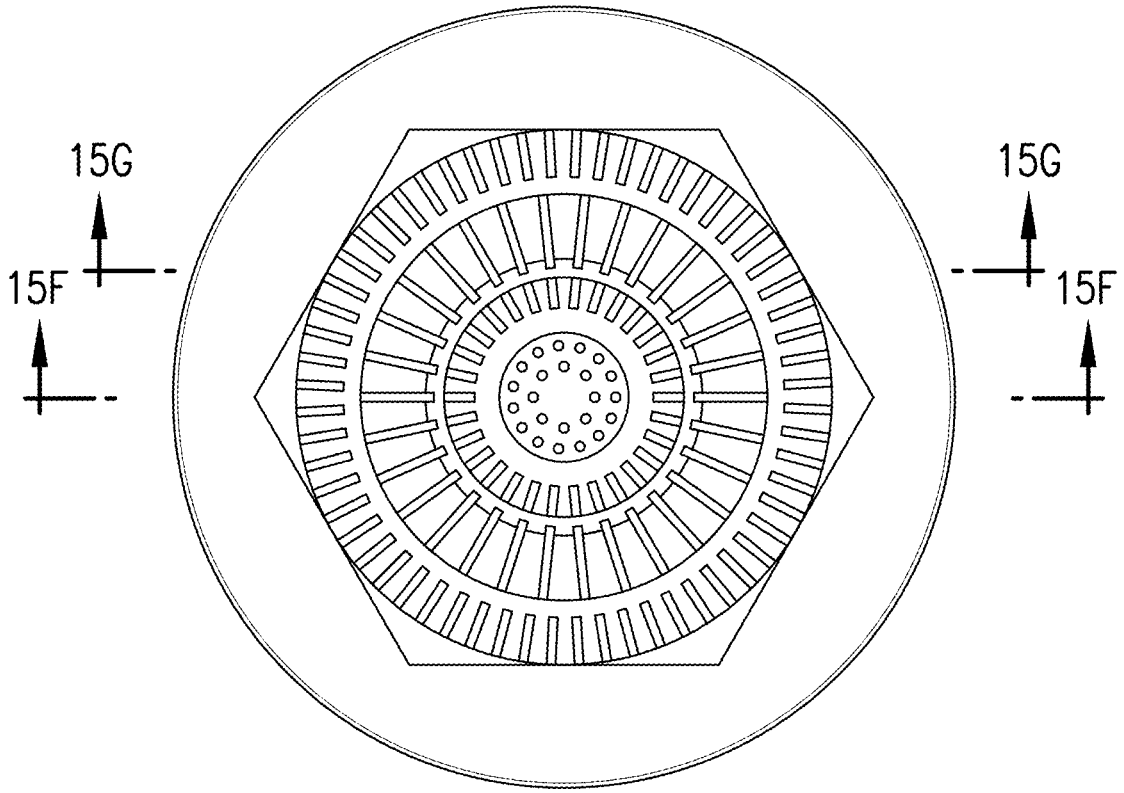
Figure 15F:
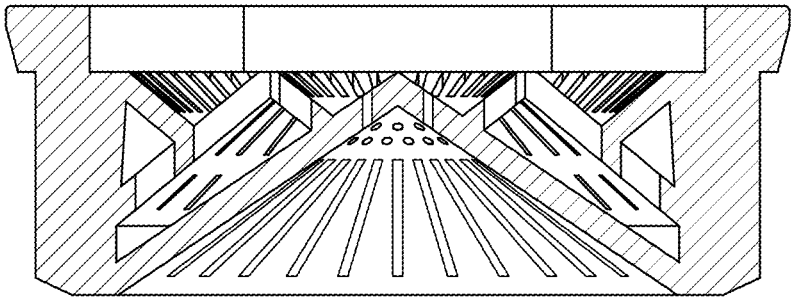
Figure 15G:
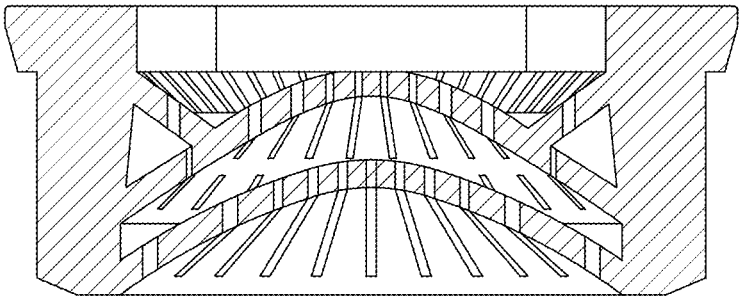
Figure 15H:
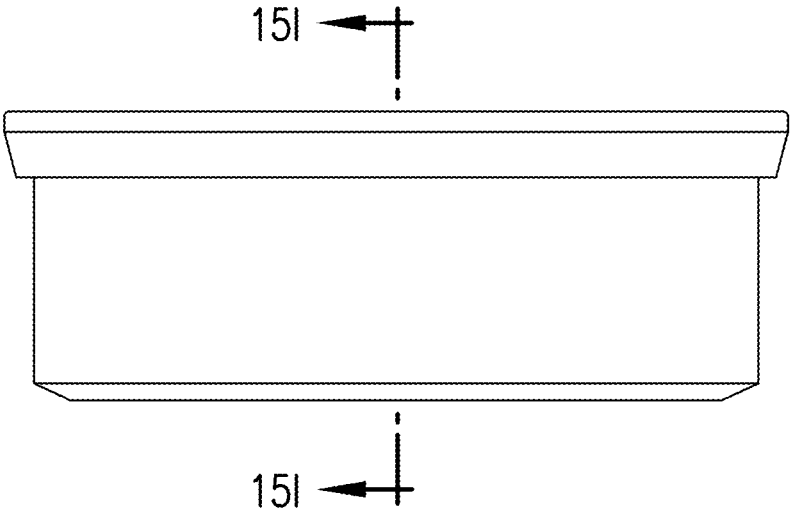
Figure 15I:
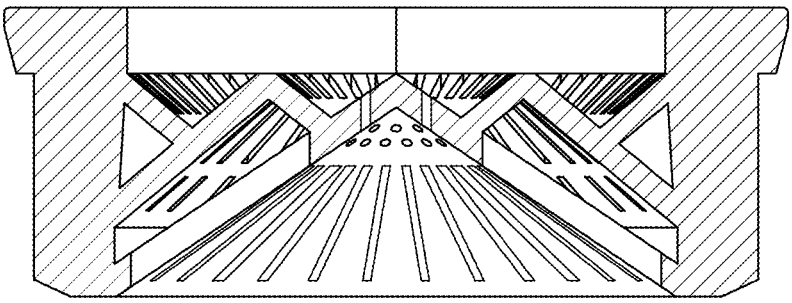
Figure 15J:
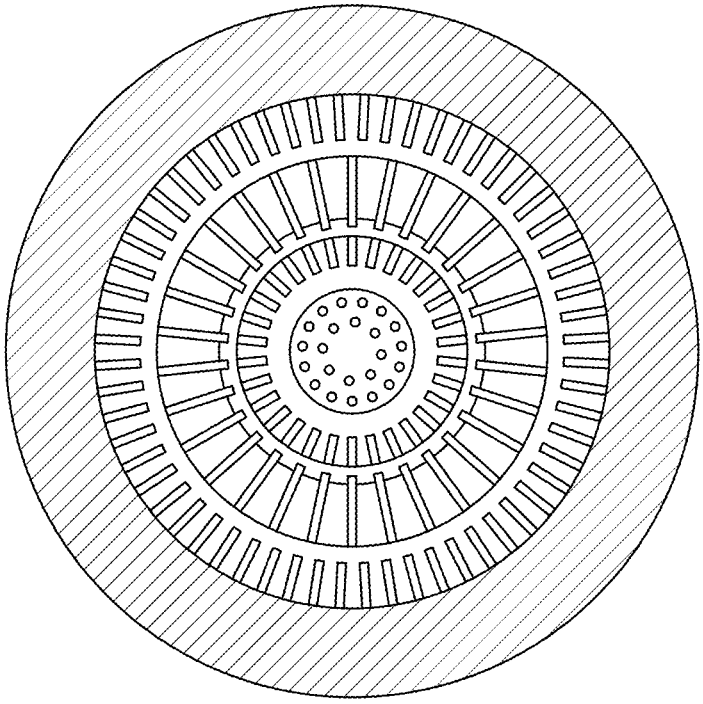
Figure 15K:
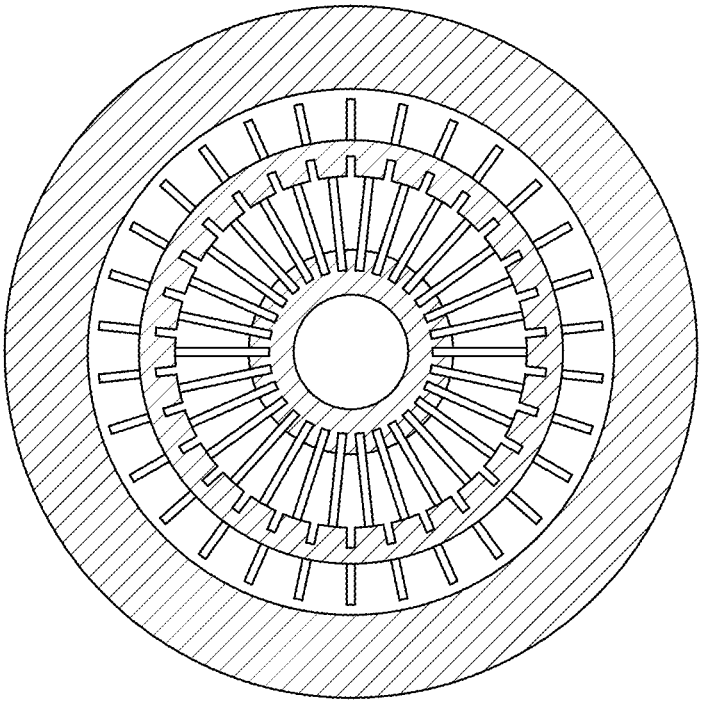
Figure 15L:
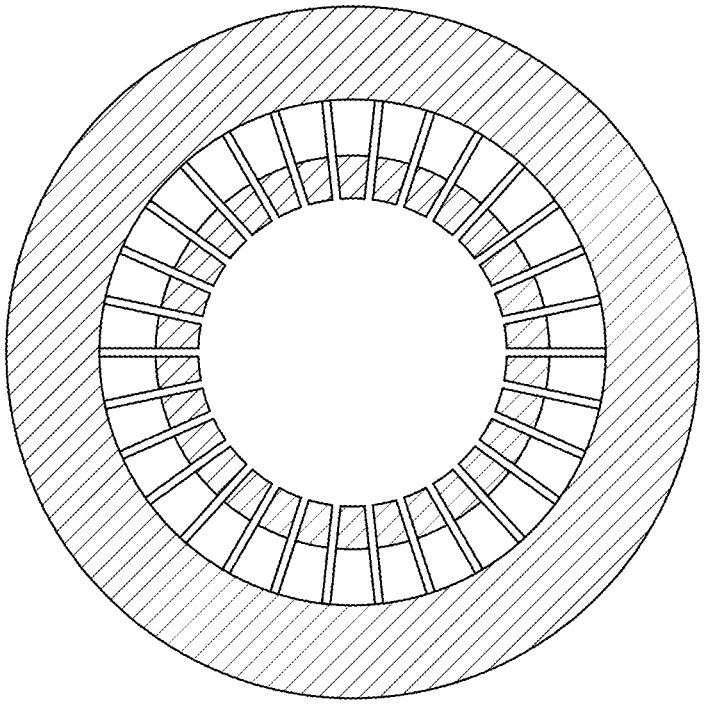
Figure 15M:
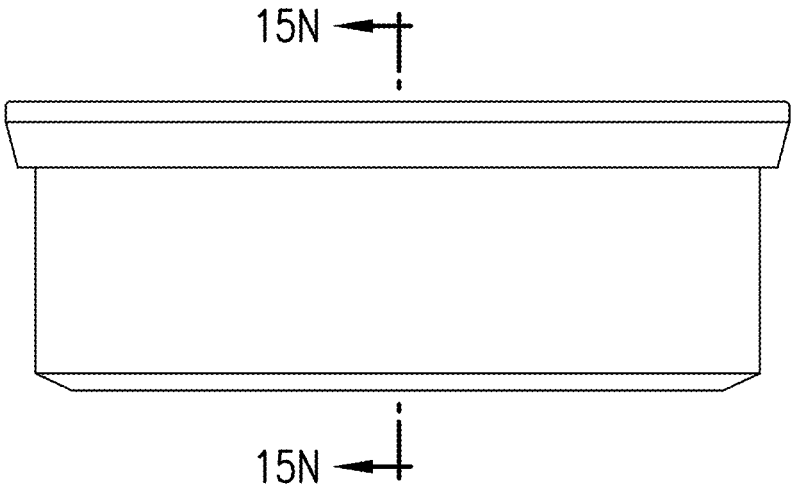
Figure 15N:
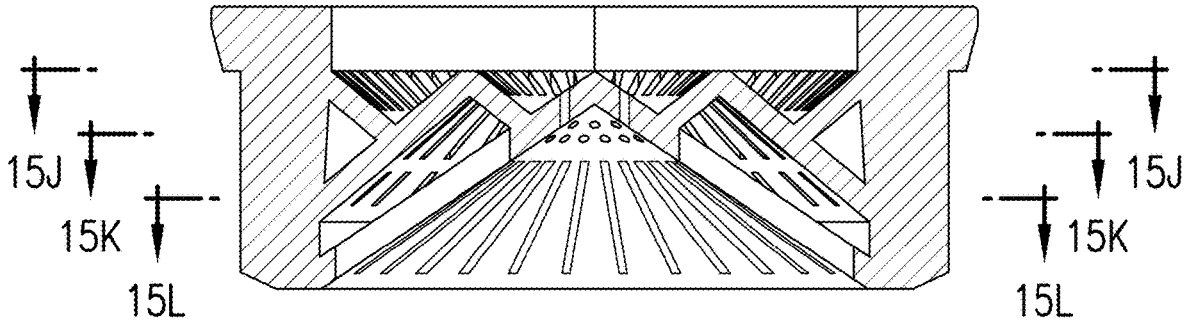
Figure 15O:
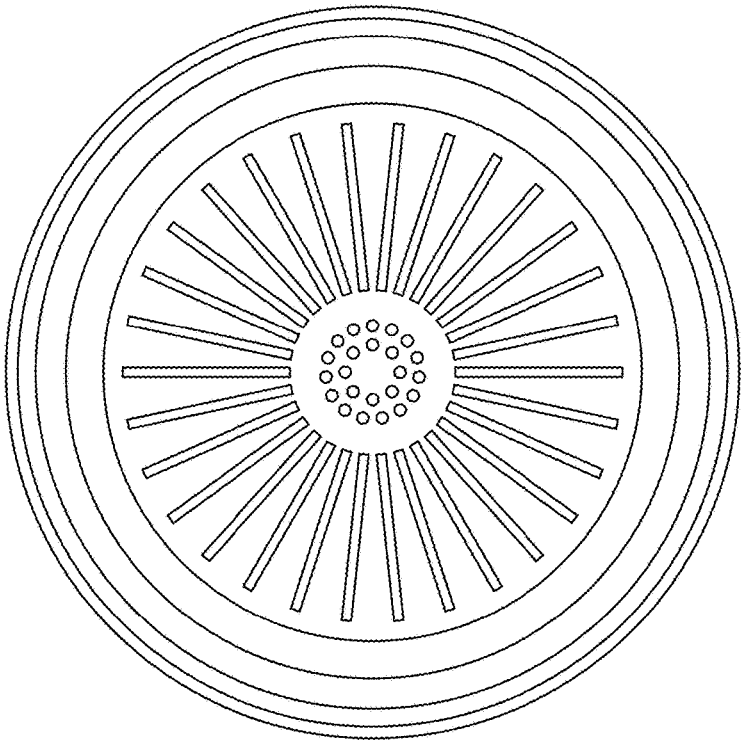
Figure 16A:
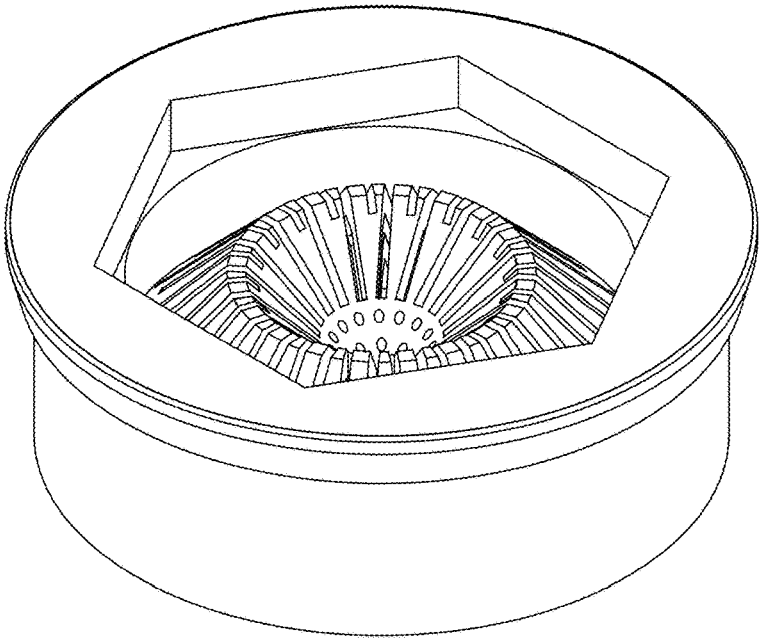
FIG. 16A-16O is an alternate embodiment.
Figure 16B:
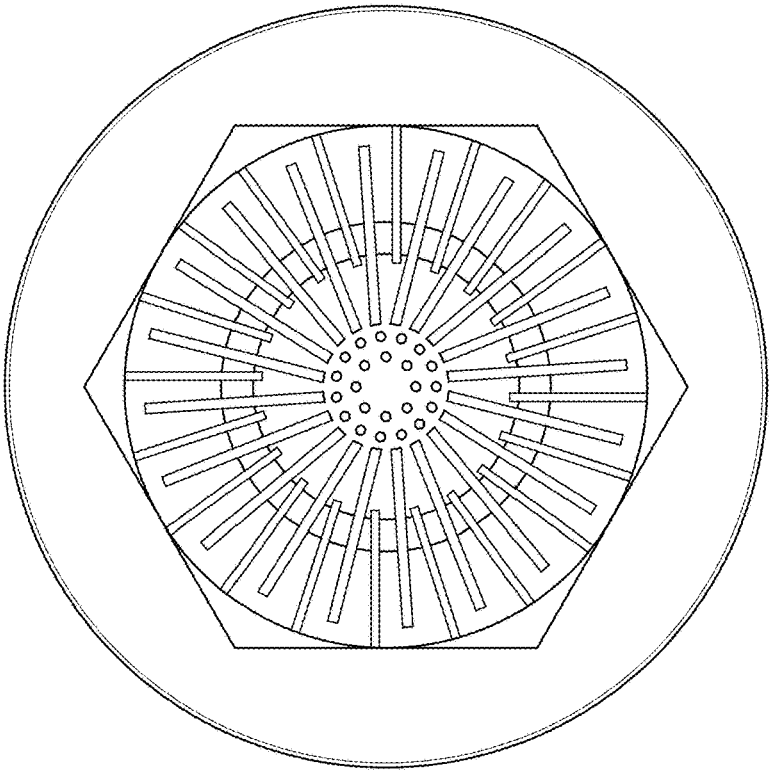
Figure 16C:
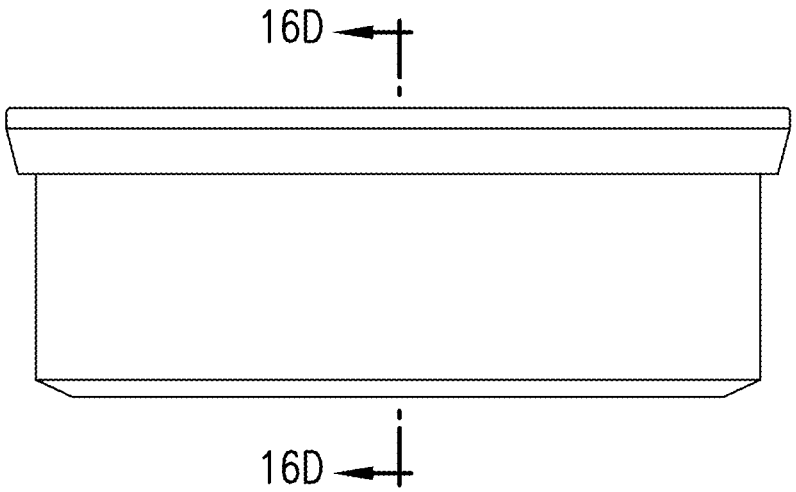
Figure 16D:
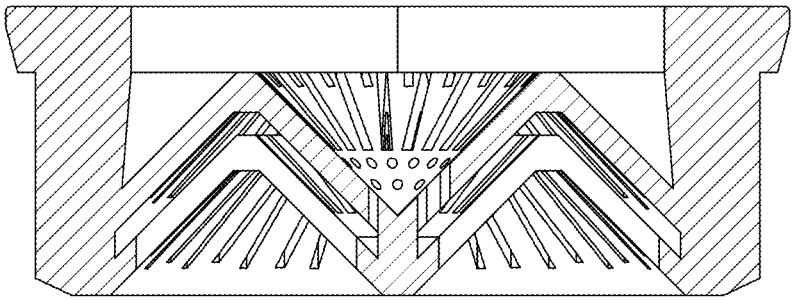
Figure 16E:
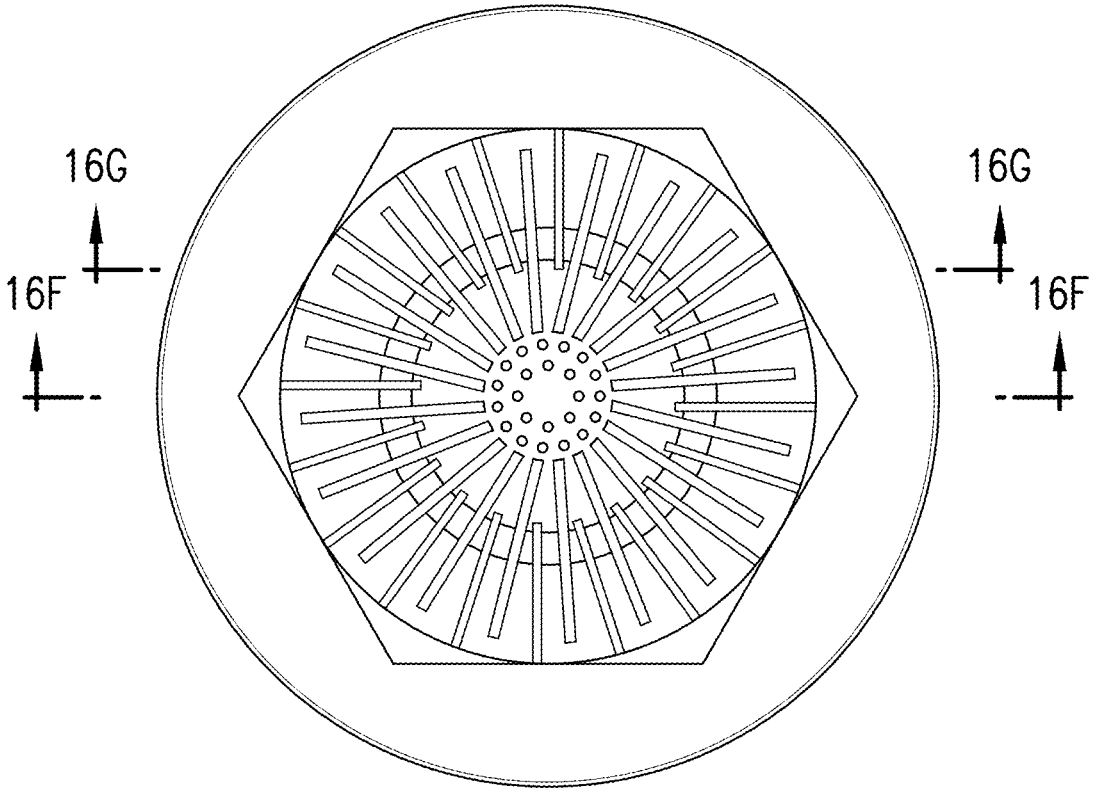
Figure 16F:
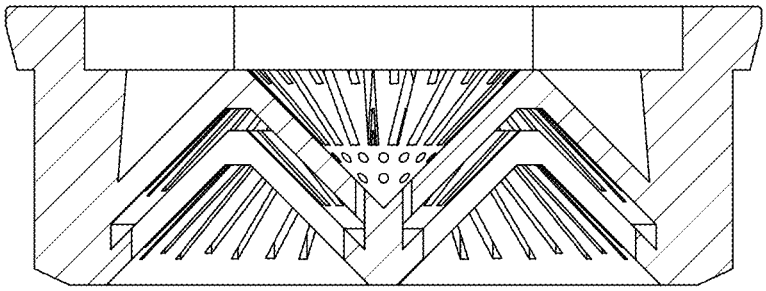
Figure 16G:
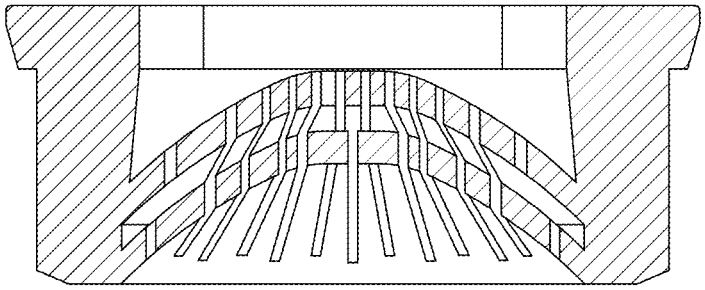
Figure 16H:
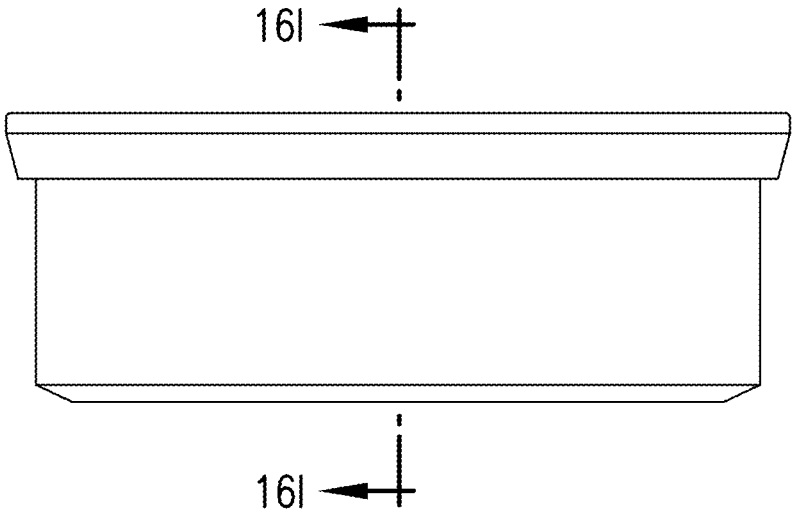
Figure 16I:
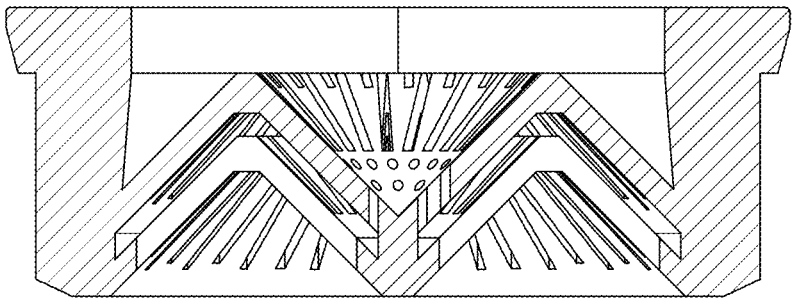
Figure 16J:
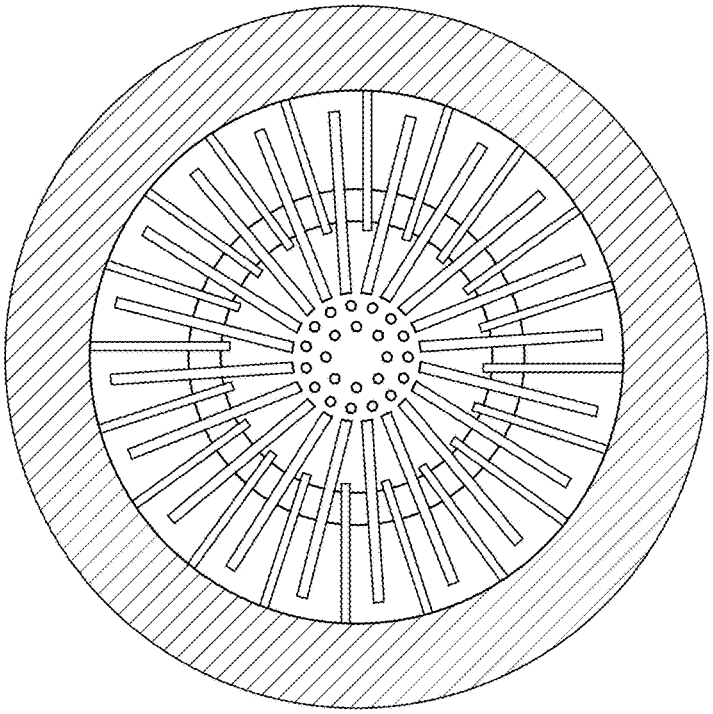
Figure 16K:
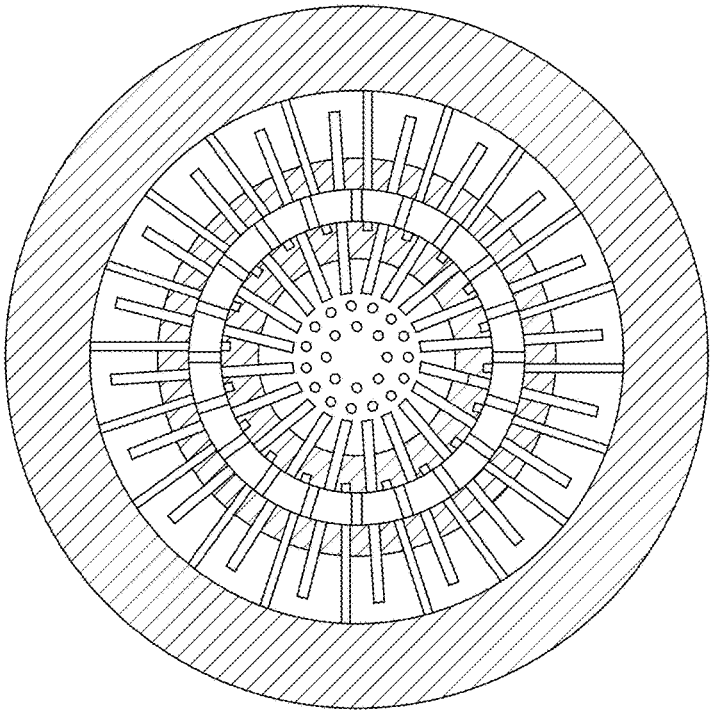
Figure 16L:
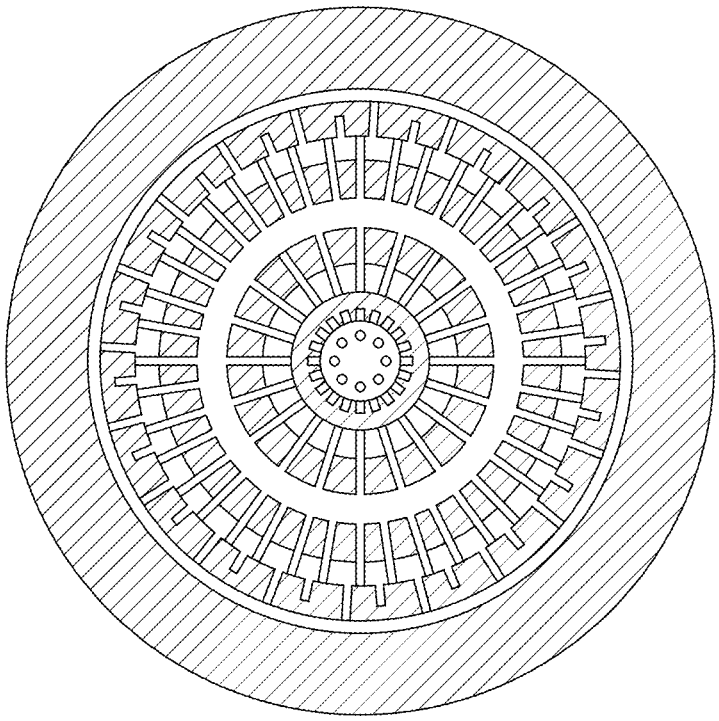
Figure 16M:
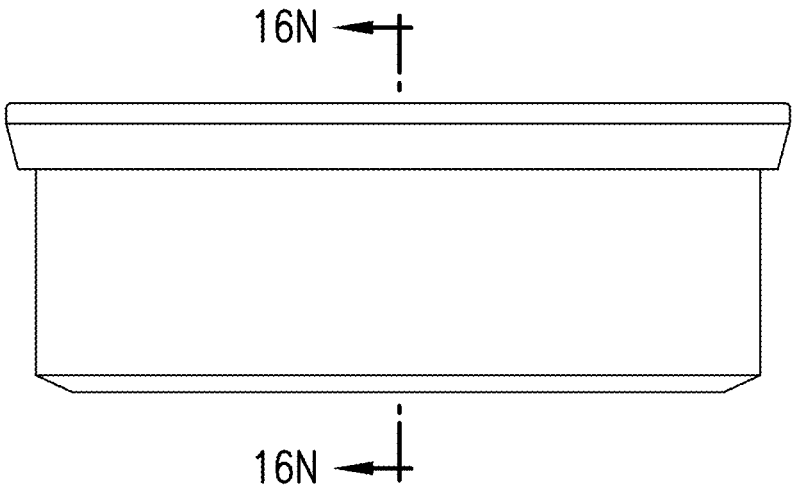
Figure 16N:
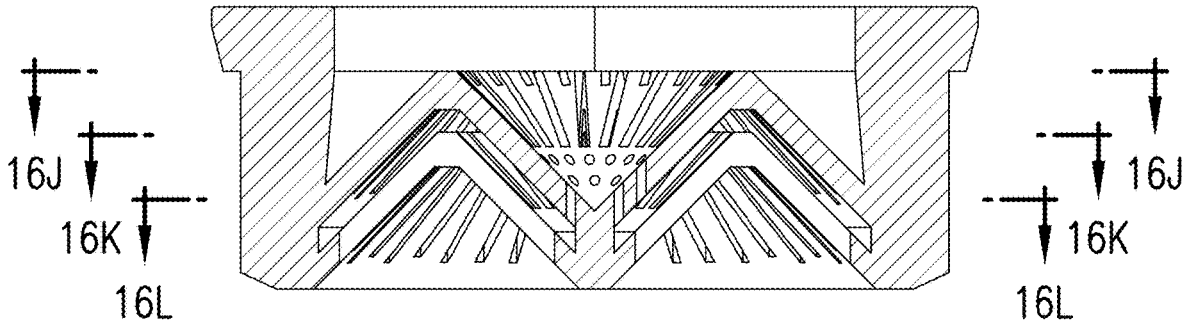
Figure 16O:
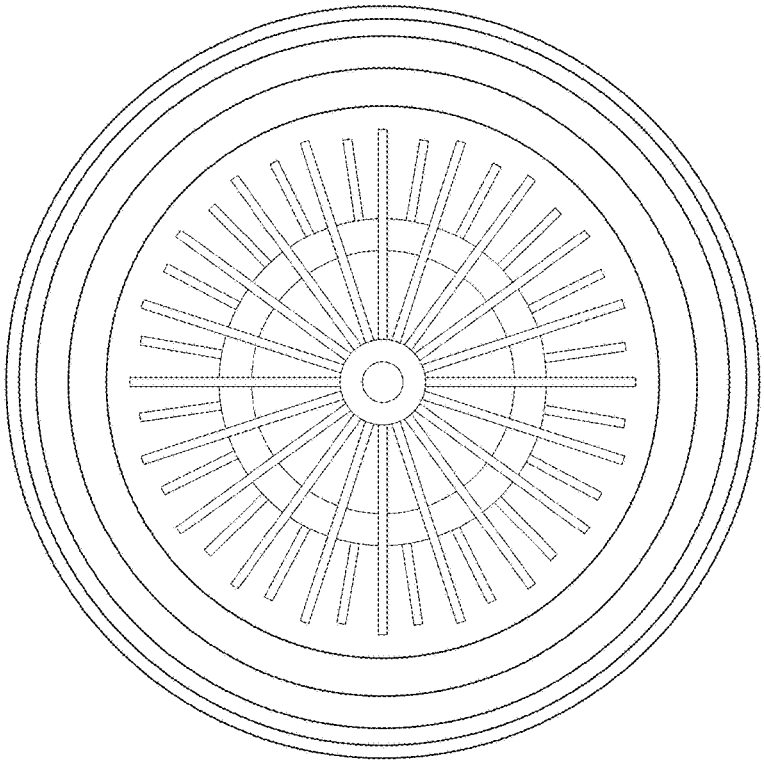
Figure 17A:
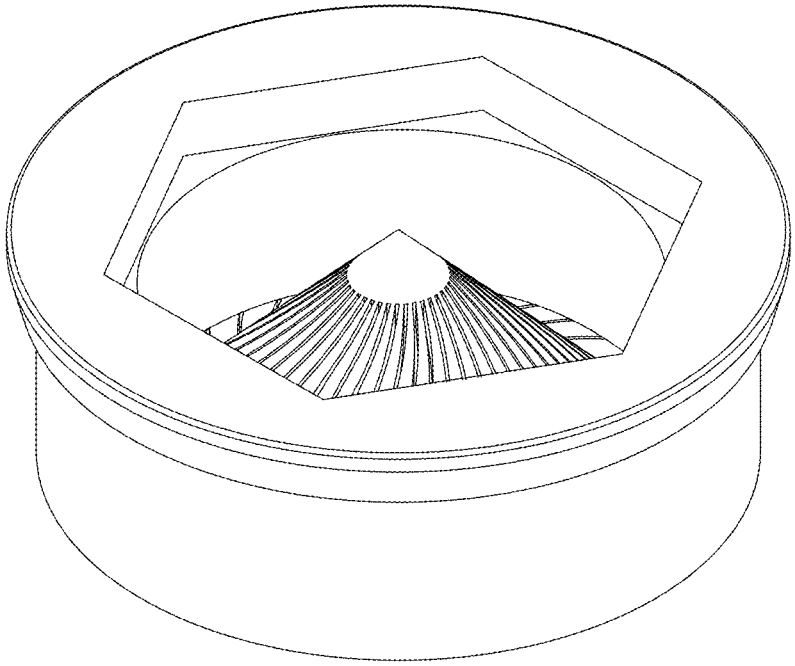
FIG. 17A-17I is an alternate embodiment.
Figure 17B:
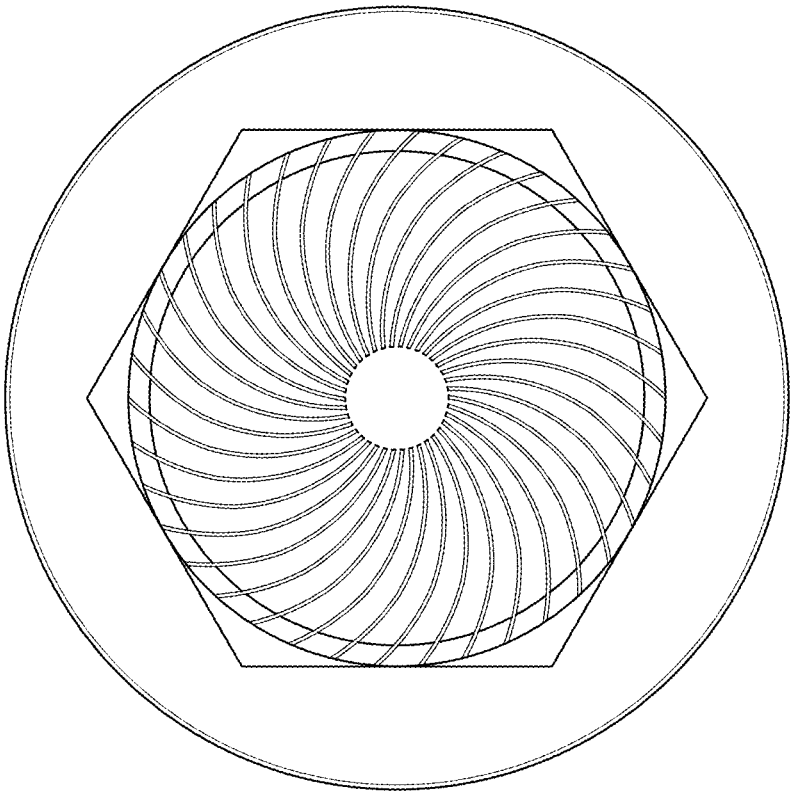
Figure 17C:
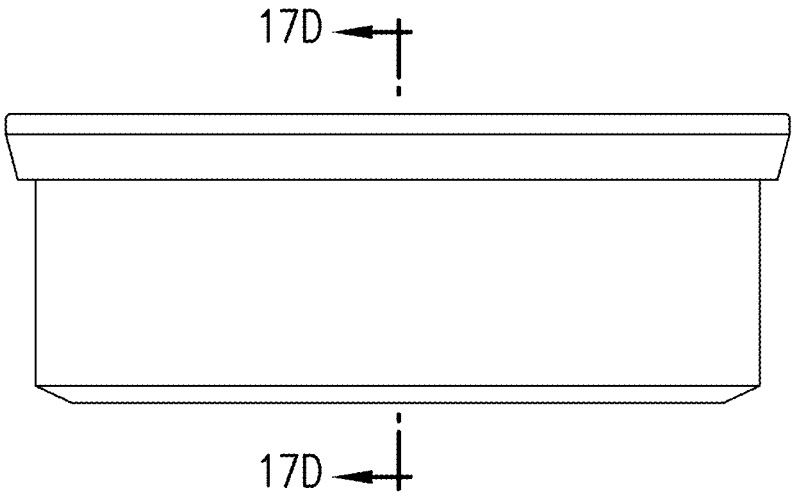
Figure 17D:
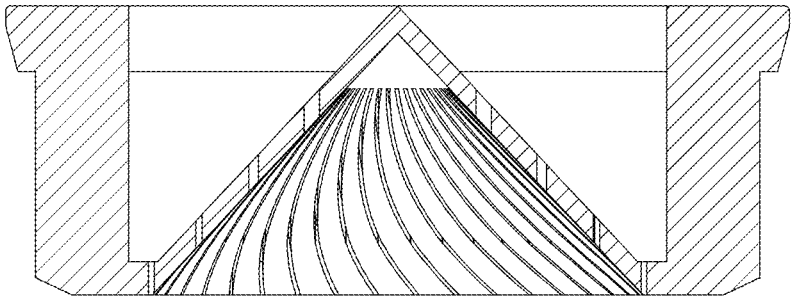
Figure 17E:
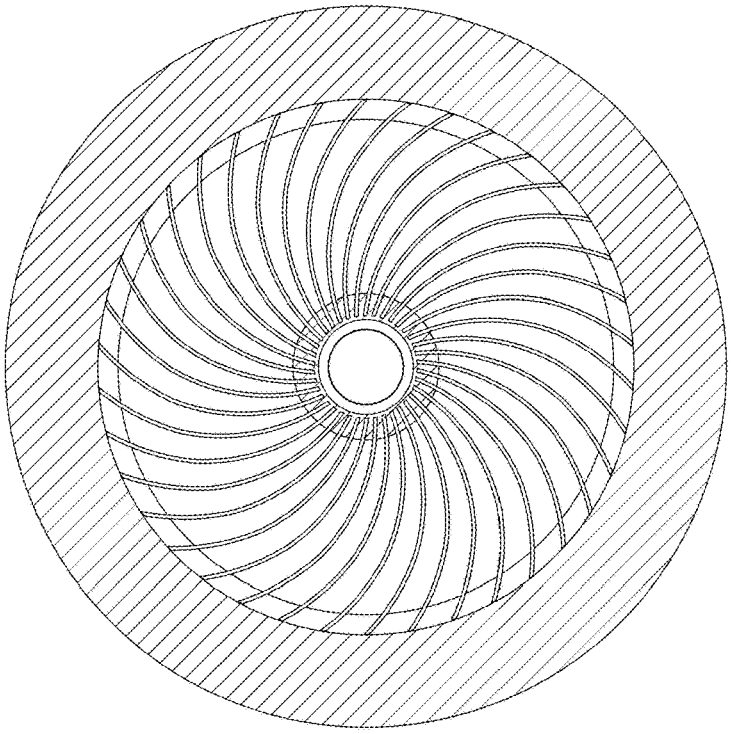
Figure 17F:
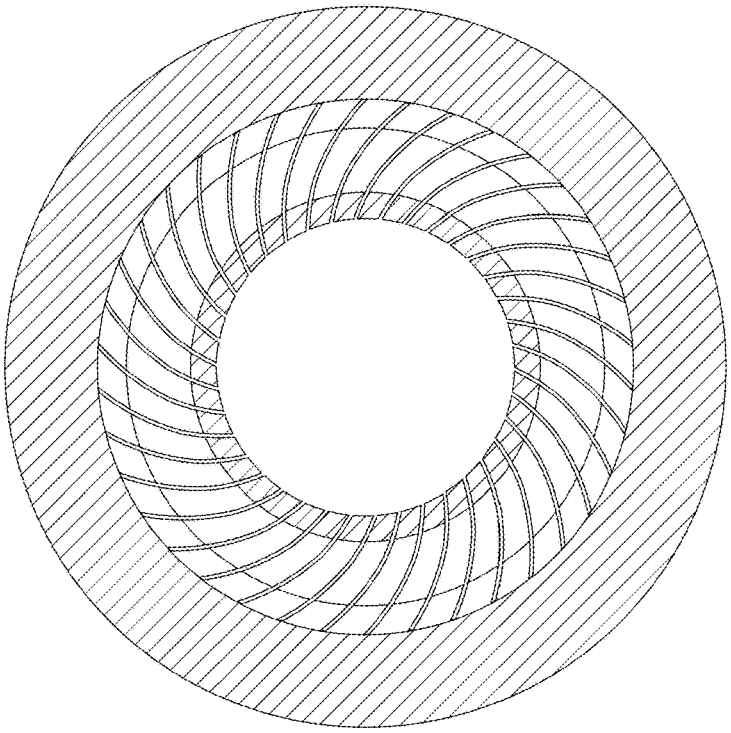
Figure 17G:
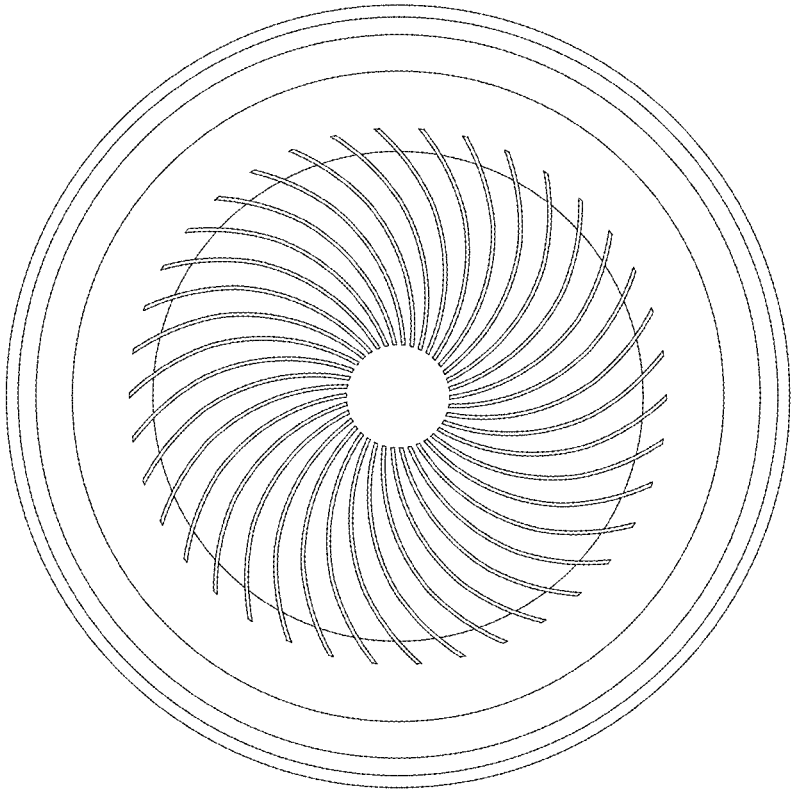
Figure 17H:
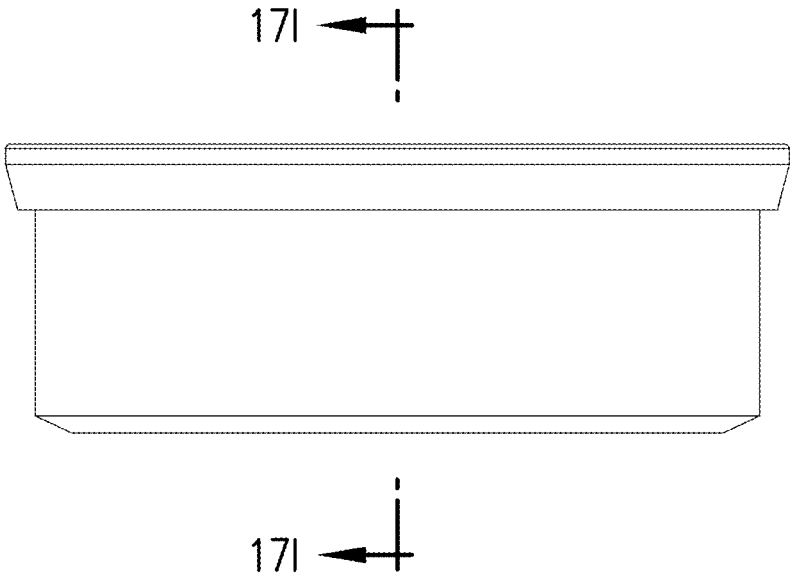
Figure 17I:
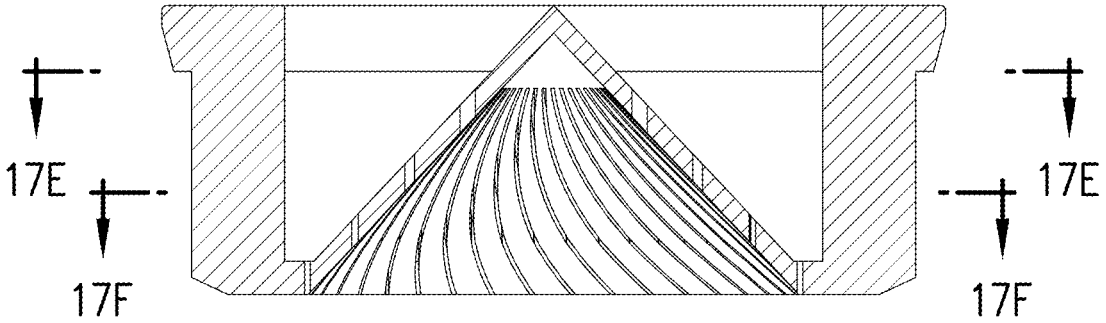

Referring to FIG. 12, a borehole system 70 is illustrated. The system 70 comprises a borehole 72 in a subsurface formation 74. A string 76 is disposed within the borehole 72. A screen 20 as disclosed herein is disposed within or as a part of the string 76.

Additional embodiments similar in some ways to FIGS. 9-11 are illustrated in FIGS. 13-17 (with alpha characters for subfigures). These embodiments provide alternatives that still benefit from the homogenous distribution of flow area taught herein.

Set forth below are some embodiments of the foregoing disclosure:

Embodiment 1: A screen including a filtration media having a manufactured structure with an interface portion and a filtration portion, the filtration portion having a homogenous geometry that precisely balances flow through all flow paths through the media.

Embodiment 2: The screen as in any prior embodiment, wherein the media includes an arch, vault or dome structure with a convexity toward an upstream direction, during use.

Embodiment 3: The screen as in any prior embodiment, wherein the media includes a plurality of arch-like, vault-like, or dome-like structures with a convexity toward an upstream direction, during use.

Embodiment 4: The screen as in any prior embodiment, wherein the media includes a shell-like, hyperbolic, or paraboloid structure with a convexity toward an upstream direction, during use.

Embodiment 5: The screen as in any prior embodiment, wherein the media includes a plurality of tensile or suspension structures transferring forces from the tensioned element to the supports of the load.

Embodiment 6: The screen as in any prior embodiment, wherein the media includes a geometry that increases a surface area thereof.

Embodiment 7: The screen as in any prior embodiment, wherein the surface area increasing geometry is a pleated geometry.

Embodiment 8: The screen as in any prior embodiment, wherein the pleated geometry is circular.

Embodiment 9: The screen as in any prior embodiment, wherein the pleated geometry is rectangular.

Embodiment 10: The screen as in any prior embodiment, wherein the media is formed in one piece through a thickness thereof.

Embodiment 11: The screen as in any prior embodiment, wherein the media is formed from a plurality of layers of material bonded together.

Embodiment 12: The screen as in any prior embodiment, wherein the media includes a restrictor layer having a reduced flow area relative to another layer of the media.

Embodiment 13: The screen as in any prior embodiment, wherein the reduced flow area creates a pressure drop.

Embodiment 14: The screen as in any prior embodiment, wherein the restrictor layer is separate from a balance of the media but secured relative thereto.

Embodiment 15: The screen as in any prior embodiment, wherein the media includes openings that are arcuate.

Embodiment 16: The screen as in any prior embodiment, wherein the media comprises a plurality of layers each layer having arcuate openings that are disposed in alternating direction per adjacent layer of the media.

Embodiment 17: The screen as in any prior embodiment, wherein the media comprises a plurality of layers each layer having arcuate openings are disposed in the same direction per adjacent layer of the media the openings being rotationally offset from adjacent layer openings.

Embodiment 18: The screen as in any prior embodiment, wherein the media includes openings that have angled walls relative to a longitudinal axis of the screen thereby creating an angular flow path through the screen, during use.

Embodiment 19: The screen as in any prior embodiment, wherein the media includes openings that are sinusoidal.

Embodiment 20: The screen as in any prior embodiment, wherein the media includes openings that promote a cyclonic movement of fluid flowing through the media, during use.

Embodiment 21: The screen as in any prior embodiment, wherein the cyclonic movement accelerates particulate entrained in the fluid radially outwardly of the media.

Embodiment 22: The screen as in any prior embodiment, wherein the media includes openings that have radiused entry.

Embodiment 23: The screen as in any prior embodiment, wherein the media includes a fluidic diode therein.

Embodiment 24: The screen as in any prior embodiment, wherein the structure interface portion includes a thread.

Embodiment 25: The screen as in any prior embodiment, wherein the structure interface portion is separate from the filtration media and bonded therewith.

Embodiment 26: A method for making a screen including determining a geometric shape of each flow path through a prospective filtration media, sequentially progressively building the media particle by particle ensuring the geometric shape of each flow path is within 0.01 mm of a design geometry, and fusing each build particle to the foregoing build particle.

Embodiment 27: A method for filtering fluid, including directing fluid through a screen as in any prior embodiment, and balancing flow in each flow path through the media thereby preventing "hot spots".

Embodiment 28: A borehole system, including a borehole in a subsurface formation, a string in the borehole, and a screen and or plurality of individually designed screens as in any prior embodiment disposed or geometrically distributed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A screen comprising:

a filtration media having a first layer with a pleated configuration and openings extending generally radially of the layer in a first direction; and a second layer with a pleated configuration and openings extending generally radially of the layer in a second direction.

2. The screen as claimed in claim 1, wherein the pleats have a convexity toward an upstream direction, during use.

3. The screen as claimed in claim 1, wherein the pleats are circumferentially oriented.

4. The screen as claimed in claim 1, wherein the media is self supporting.

5. The screen as claimed in claim 1, wherein the media is formed in one.

6. The screen as claimed in claim 1, wherein the media is formed from a plurality of layers of material bonded together.

7. The screen as claimed in claim 1, wherein the media includes a restrictor layer having a reduced flow area relative to another layer of the media.

8. The screen as claimed in claim 5, wherein the restrictor layer is separate from a balance of the media but secured relative thereto.

9. The screen as claimed in claim 1, wherein the openings in one of the first and second layers are arcuate.

10. The screen as claimed in claim 9, wherein the arcuate openings of the first and second layers curve in a direction that is on the same or different in adjacent layers.

11. The screen as claimed in claim 10, wherein the arcuate openings are rotationally offset in adjacent layer openings.

12. The screen as claimed in claim 1, wherein the openings have angled walls relative to a longitudinal axis of the screen thereby creating an angular flow path through the screen, during use.

13. The screen as claimed in claim 12, wherein the media openings promote a cylclonic flow of fluid through the media, during use.

14. The screen as claimed in claim 13, wherein the cyclonic movement accelerates particulate entrained in the fluid radially outwardly of the media.

15. The screen as claimed in claim 1, wherein the openings have radiused entry.

16. The screen as claimed in claim 1, wherein the structure interface portion includes a thread.

17. The screen as claimed in claim 1, wherein the structure interface portion is separate from the filtration media and bonded therewith.

18. A borehole system, comprising:

a borehole in a subsurface formation;

a string in the borehole; and a screen and or plurality of individually designed screens as claimed in claim 1 disposed or geometrically distributed within or as a part of the string.

* * * * *